US011430398B2

(12) United States Patent
Buckley

(10) Patent No.: US 11,430,398 B2
(45) Date of Patent: Aug. 30, 2022

(54) SYSTEMS AND METHODS FOR MASK-BASED SPATIO-TEMPORAL DITHERING

(71) Applicant: Facebook Technologies, LLC, Menlo Park, CA (US)

(72) Inventor: Edward Buckley, Redmond, WA (US)

(73) Assignee: Facebook Technologies, LLC., Menlo Park, CA (US)

( * ) Notice: Subject to any disclaimer, the term of this patent is extended or adjusted under 35 U.S.C. 154(b) by 0 days.

(21) Appl. No.: 17/477,179

(22) Filed: Sep. 16, 2021

(65) Prior Publication Data

US 2022/0051637 A1 Feb. 17, 2022

Related U.S. Application Data

(63) Continuation of application No. 16/521,367, filed on Jul. 24, 2019, now Pat. No. 11,158,270.

(51) Int. Cl.

| | |
|---|---|
| ***G09G 3/20*** | (2006.01) |
| ***G09G 3/36*** | (2006.01) |
| ***G09G 5/02*** | (2006.01) |
| ***G09G 5/10*** | (2006.01) |
| ***G09G 5/393*** | (2006.01) |

(52) U.S. Cl.

CPC ..... *G09G 3/3607* (2013.01); *G09G 3/2048* (2013.01); *G09G 5/028* (2013.01); *G09G 5/10* (2013.01); *G09G 5/393* (2013.01); *G09G 2310/027* (2013.01)

(58) Field of Classification Search

CPC .... G09G 3/3607; G09G 3/2048; G09G 5/028; G09G 5/10; G09G 5/393; G09G 2310/027

See application file for complete search history.

(56) References Cited

U.S. PATENT DOCUMENTS

| | | | | |
|---|---|---|---|---|
| 2008/0224976 A1* | 9/2008 | Lee | G09G 3/2055 | 345/89 |
| 2011/0141365 A1* | 6/2011 | Park | G09G 3/2055 | 348/E9.037 |
| 2016/0057437 A1* | 2/2016 | Jeong | H04N 19/426 | 375/240.25 |

* cited by examiner

*Primary Examiner* — Roy P Rabindranath
(74) *Attorney, Agent, or Firm* — Baker Botts L.L.P.

(57) ABSTRACT

In one embodiment, a computing system may receive a target image with a first number of bits per color and access a seed mask from a storage media. The system may generate a set of masks based on the seed mask. Each of the masks may include a number of first dot patterns that observe a spatial stacking property. The system may generate a number of images based on the target image and the set of masks. Each of the images may have a second number of bits per color smaller than the first number of bits per color. The system may display the images sequentially in time domain on a display for representing the target image. The images may have a number of second dot patterns for representing corresponding grayscale values. The second dot patterns of the images may observe a temporal stacking property across the images.

20 Claims, 15 Drawing Sheets

400B

400D

400A

400C

500A

500B

500C

500D

600A

600B

600C

600D

600E

700A

700B

700C

700D

800A

800B

800C

800D

800E

SYSTEMS AND METHODS FOR MASK-BASED SPATIO-TEMPORAL DITHERING

PRIORITY

This application is a continuation under 35 U.S.C. § 120 of U.S. patent application Ser. No. 16/521,367, filed 24 Jul. 2019, which is incorporated herein by reference.

TECHNICAL FIELD

This disclosure generally relates to artificial reality, such as virtual reality and augmented reality.

BACKGROUND

Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured content (e.g., real-world photographs). The artificial reality content may include video, audio, haptic feedback, or some combination thereof, and any of which may be presented in a single channel or in multiple channels (such as stereo video that produces a three-dimensional effect to the viewer). Artificial reality may be associated with applications, products, accessories, services, or some combination thereof, that are, e.g., used to create content in an artificial reality and/or used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

SUMMARY OF PARTICULAR EMBODIMENTS

Particular embodiments described herein relate to a method of using multiple dithering masks to generate spatio-temporal subframe images with less gray level bits (or color depth) to represent a target image with more gray level bits, without using an error buffer. The temporal subframe images may have smooth dithering pattern transition between grayscale levels and minimal temporal change among the subframes. For a target region (e.g., a tile region) of the target image, the system may generate a dithering mask for each subframe image. Each dithering mask may include a dot pattern with blue-noise distribution and satisfy spatial-stacking constraints. The dot pattern may include a number of stacked dot patterns with each dot pattern having a dot density corresponding to a grayscale level within the quantization range (e.g., 0~255 grayscale levels for 8-bit display). All dot patterns may be chosen to have blue-noise properties and may have a spatial stacking property according to which the dot pattern for grayscale level N+1 may include the dot pattern for all lower grayscale levels of 0 to N. Each dot in the dithering mask may correspond to a threshold value which equals to the lowest grayscale level for turning on that that dot (i.e., the lowest grayscale level with the corresponding dot pattern that includes that dot).

In particular embodiments, for representing a target grayscale value g (e.g., an average grayscale value of a target tile region), the dot patterns corresponding to all lower grayscale levels may be spatially stacked to represent the target grayscale level up to a distribution limit $g_L$ (e.g., the dot pattern of the target grayscale level may include all dots of lower grayscale levels). The distribution limit $g_L$ (e.g., 0.25) may be determined by dividing the maximum grayscale level (e.g., 1) by the number of subframes (e.g., 4 subframes). Under the condition of $g<g_L$ the dot pattern of each dithering mask of each subframe may include a subset dots with have no overlapping dots with any other subframes. For presenting grayscale higher than the distribution limit $g_L$ (e.g., $g>0.25$), additional dots could be incrementally added and turned on. To ensure temporal consistency, the dots that are incrementally added may be selected from the dots that are included in one or more dithering masks of the other subframes. For example, for quantizing grayscale between the distribution limit $g_L$ to two times of distribution limit $2g_L$ (e.g., $0.25<g<0.5$), the dots added to the first subframe (which is at grayscale 0.25) may be incrementally selected from the dots included in the dithering mask of the second subframe. As another example, for quantizing grayscale in the range of two times of distribution limit $2g_L$ to three times of distribution limit $3g_L$ (e.g., $0.5<g<0.75$), the dots to be turned on may include dots of the first and second subframe dithering masks (e.g., which are both at grayscale 0.25). The dots that are incrementally added may be selected from the dots included in the dithering mask of third subframe. The dither masks for generating the subframe images may be pre-determined and may be available for use when needed by the process for generating the subframe images. Therefore, all subframe images may be generated at essential the same time (or generated parallelly) and the quantization errors may be dithered in the temporal domain to other subframes during the subframe image generating process. Therefore, the system may not need to store the quantization error for temporal dithering process to other subframes. As a result, using the dithering masks generated following these principles, the temporal subframe images may be generated without using an error buffer, and therefore reduce the memory usage related to the subframe image generating processes. The subframe images may have smooth dither pattern transition between grayscales and minimal temporal change among the subframes.

In particular embodiments, the multiple masks used to generate the subframes may be generated from a single seed mask stored in the computer storage. The system may store the single seed mask instead of the multiple dithering masks to reduce the storage memory usage related to the subframe generating process. For an arbitrary number of subframes N, the mask for the n-th subframe may be generated by cyclically permuting the seed mask. For a target grayscale level g, the system may determine an offsetting coefficient $k_n$ based on a remainder of $(n-1)\cdot g$ divided by $g_{max}$, which is the maximum grayscale level. Then, the system may determine the threshold values of a subsequent subframe mask based on a remainder of $(t_1-k_n)$ divided by $g_{max}$, where $t_1$ is a threshold value for a dot in the first mark. As an example, for a target grayscale of 0.25 in a grayscale range of [0, 1] and 4 subframes, the first, second, third and fourth subframe masks may include the dots that have the threshold values within the ranges of [0, 0.25], [0.25, 0.5], [0.5, 0.75] and [0.75, 1], respectively. The threshold values of the first, second, third and fourth subframe dithering masks may be determined by $\mathrm{mod}(t_1-0), 1)$, $\mathrm{mod}(t_1-0.25, 1)$, $\mathrm{mod}(t_1-0.5, 1)$ and $\mathrm{mod}(t_1-0.75, 1)$, respectively. As another example, for a target grayscale of 0.6 within a grayscale range of [0, 1] and 4 subframes, the first, second, third and fourth subframe masks may include the dots that have the threshold values within the ranges of [0, 0.6], [0.2, 0.8], [0.4, 1] and [0.2, 0.8], respectively. The threshold values of the first, second, third and fourth subframe masks may be determined by mod($t_1$−0), 1), mod($t_1$−0.2, 1), mod($t_1$−0.3, 1) and mod ($t_1$−0.2, 1), respectively.

The embodiments disclosed herein are only examples, and the scope of this disclosure is not limited to them. Particular embodiments may include all, some, or none of the components, elements, features, functions, operations, or steps of the embodiments disclosed above. Embodiments according to the invention are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

In an embodiment, a method may comprise, by a computing system:

receiving a target image with a first number of bits per color;

accessing masks that each comprises dots associated with a grayscale range, wherein a subset of the dots associated with each of the masks is associated with a subrange of the grayscale range, wherein dots within the subsets of dots associated with the masks have different positions;

generating a plurality of images based on the target image and the masks, wherein each of the plurality of images has a second number of bits per color smaller than the first number of bits per color; and displaying the plurality of images sequentially on a display for representing the target image.

The dots of each mask may be associated with a dot pattern, the dot pattern may comprise a plurality of stacked dot patterns, and each of the plurality of stacked dot patterns may satisfy a spatio stacking constraint by comprising all dot patterns corresponding to all lower grayscale levels.

Each dot of the dot pattern may be associated with a threshold value, and the threshold value may correspond to a lowest grayscale level which has a corresponding dot pattern that comprises that dot.

Each mask may have threshold values corresponding to all grayscale levels of a quantization grayscale range corresponding to the second number of bits per color.

The plurality of stacked dot patterns may correspond to all grayscale levels of the quantization grayscale range.

The dots in the dot pattern of each mask may have a blue-noise property.

A sum of the dot patterns of the masks may have a blue-noise property.

The plurality of images may be generated by satisfying a temporal stacking constraint, and the temporal stacking constraint may allow the plurality of images to have the luminosity within a threshold range.

The display may have the second number of bits per color.

In an embodiment, the masks may be available at a same time for a process of generating the plurality of images, and a method may comprise:

determining one or more quantitation errors based on one or more color values of the target image and one or more threshold values associated with one of the masks; and dithering the one or more quantization errors temporally to one or more images without using an error buffer.

In an embodiment, a method may comprise:

generating a seed mask comprising threshold values covering a quantization grayscale range;

storing the seed mask in a storage media; and accessing the seed mask from the storage media, wherein the plurality of masks are generated from the seed mask based on a cyclical relationship.

The quantization grayscale range may have a plurality of evenly-placed grayscale levels.

The quantization grayscale range may have a plurality of unevenly-placed grayscale levels.

In an embodiment, a method may comprise:

determining a grayscale limit based on a maximum grayscale level and a number of images for representing the target image.

When a target grayscale value associated with the target image is smaller than the grayscale limit, corresponding regions of the plurality of images may comprise non-overlapping sets of pixels from each other.

When a target grayscale value associated with the target image is greater than the grayscale limit, corresponding regions of the plurality of images may comprise overlapping sets of pixels, and wherein the overlapping sets of pixels are determined by incrementally selecting dots from at least another mask of the masks.

An average grayscale value of a target region of the target image may be used as a target grayscale value, and each of the plurality of masks may have a same size to the target region of the target image.

The plurality of images may be generated by repeatedly applying a corresponding mask to the target image.

In an embodiment, one or more computer-readable non-transitory storage media may embody software that is operable when executed to:

receive a target image with a first number of bits per color;

access masks that each comprises dots associated with a grayscale range, wherein a subset of the dots associated with each of the masks is associated with a subrange of the grayscale range, wherein dots within the subsets of dots associated with the masks have different positions;

generate a plurality of images based on the target image and the masks, wherein each of the plurality of images has a second number of bits per color smaller than the first number of bits per color; and display the plurality of images sequentially on a display for representing the target image.

In an embodiment, a system may comprise: one or more non-transitory computer-readable storage media embodying instructions; and one or more processors coupled to the storage media and operable to execute the instructions to:

receive a target image with a first number of bits per color;

access masks that each comprises dots associated with a grayscale range, wherein a subset of the dots associated with each of the masks is associated with a subrange of the grayscale range, wherein dots within the subsets of dots associated with the masks have different positions;

generate a plurality of images based on the target image and the masks, wherein each of the plurality of images has a second number of bits per color smaller than the first number of bits per color; and display the plurality of images sequentially on a display for representing the target image.

DESCRIPTION OF EXAMPLE EMBODIMENTS

Figure 1A:
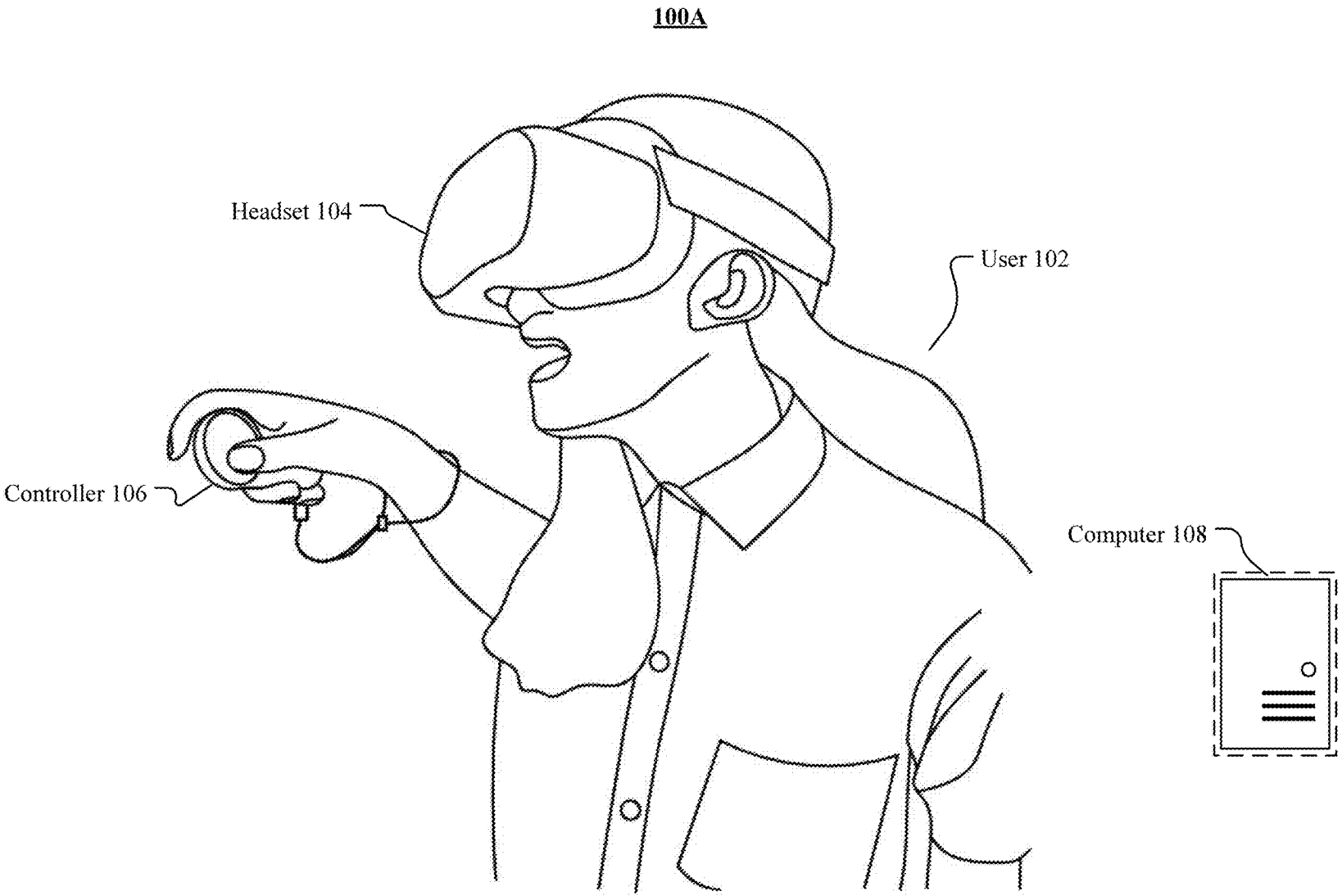
FIG. 1A illustrates an example artificial reality system.

The number of available bits in a display may limit the display's color depth or gray scale level. Displays with limited color depth or gray scale level may use spatio dithering to generate the illusion of increased color depth or gray scale level, for example, by spreading quantization errors to neighboring pixels. To further increase the color depth or gray scale level, displays may generate a series of temporal subframe images with less gray level bits to give the illusion of a target image which has more gray level bits. Each subframe image may be generated using dithering techniques (e.g., spatio-temporal dithering methods). However, these dithering techniques may need an error buffer to provide temporal feedback, and therefore use more memory space.

To reduce the memory usage related to processes of generating subframe images, particular embodiments of the system may use a number of dithering masks to generate a series of subframe images with even luminance distribution across all subframe images to represent a target image. For generating N subframe images, the system may generate a dithering mask for each subframe image. Each dithering mask may include a number of dot patterns with each dot pattern having a dot density corresponding to a grayscale level within the quantization range (e.g., 0~255 grayscale levels for 8-bit display). The dot patterns may be generated based on blue-noise distribution and satisfy spatial stacking property. For example, the dot pattern for grayscale level N may include the dot patterns for all lower grayscale levels form 0 to N. The dithering mask may include the dot patterns corresponding to all grayscale levels of the quantization range. Each dot in the dithering mask may correspond to a threshold value which equals to the lowest grayscale level allowing that dot to be included in a dot pattern. The system may generate the subframe images based on the dithering masks without using an error buffer.

Particular embodiments of the system improve the efficiency of AR/VR display by reducing the memory usage related to generating the temporal subframe images without using an error buffer. Particular embodiments of the system provide better image quality and improve user experience for AR/VR display by using multiple subframe images with less color depth to represent an image with greater color depth. Particular embodiments of the system generate subframe images with more even luminance distribution across the subframe images for representing the target image and eliminate the temporal artifacts such as flashes or uneven luminance over time in AR/VR display when the user's eyes and head positions change between the subframe images. Particular embodiments of the system allow AR/VR display system to reduce the space and complexity of pixel circuits by having less gray level bits, and therefore miniaturize the size of the display system. Particular embodiments of the system make it possible for AR/VR displays to operate in monochrome mode with digital pixel circuits and eliminating analog pixel circuits for full RGB operations.

FIG. 1A illustrates an example artificial reality system 100A. In particular embodiments, the artificial reality system 100 may comprise a headset 104, a controller 106, and a computing system 108. A user 102 may wear the headset 104 that may display visual artificial reality content to the user 102. The headset 104 may include an audio device that may provide audio artificial reality content to the user 102. The headset 104 may include one or more cameras which can capture images and videos of environments. The headset 104 may include an eye tracking system to determine the vergence distance of the user 102. The headset 104 may be referred as a head-mounted display (HDM). The controller 106 may comprise a trackpad and one or more buttons. The controller 106 may receive inputs from the user 102 and relay the inputs to the computing system 108. The controller 206 may also provide haptic feedback to the user 102. The computing system 108 may be connected to the headset 104 and the controller 106 through cables or wireless connections. The computing system 108 may control the headset 104 and the controller 106 to provide the artificial reality content to and receive inputs from the user 102. The computing system 108 may be a standalone host computer system, an on-board computer system integrated with the headset 104, a mobile device, or any other hardware platform capable of providing artificial reality content to and receiving inputs from the user 102.

Figure 1B:
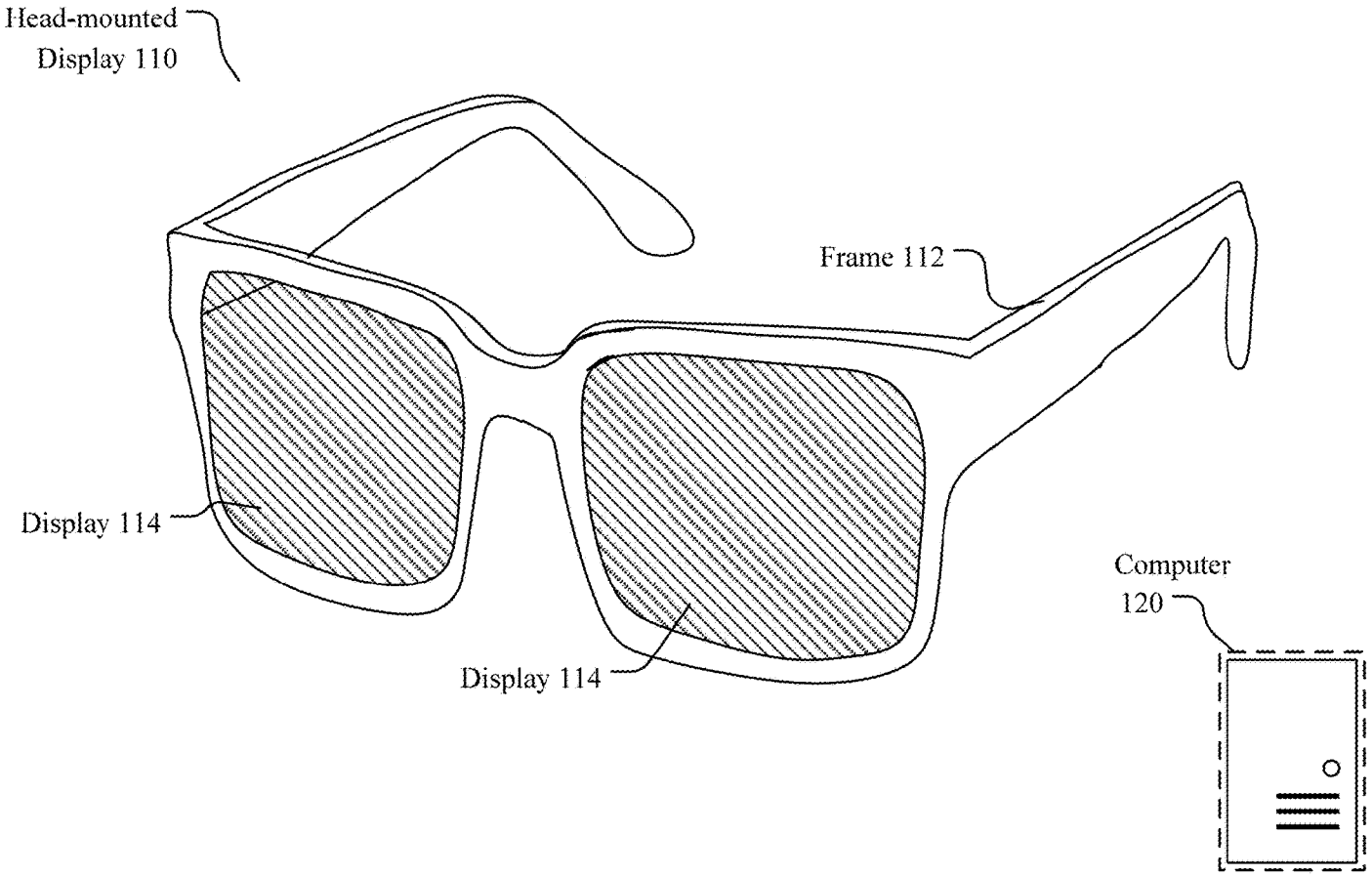
FIG. 1B illustrates an example augmented reality system.

FIG. 1B illustrates an example augmented reality system 100B. The augmented reality system 100B may include a head-mounted display (HMD) 110 (e.g., glasses) comprising a frame 112, one or more displays 114, and a computing system 120. The displays 114 may be transparent or translucent allowing a user wearing the HMD 110 to look through the displays 114 to see the real world and displaying visual artificial reality content to the user at the same time. The HMD 110 may include an audio device that may provide audio artificial reality content to users. The HMD 110 may include one or more cameras which can capture images and videos of environments. The HMD 110 may include an eye tracking system to track the vergence movement of the user wearing the HMD 110. The augmented reality system 100B may further include a controller comprising a trackpad and one or more buttons. The controller may receive inputs from users and relay the inputs to the computing system 120. The controller may also provide haptic feedback to users. The computing system 120 may be connected to the HMD 110 and the controller through cables or wireless connections. The computing system 120 may control the HMD 110 and the controller to provide the augmented reality content to and receive inputs from users. The computing system 120 may be a standalone host computer system, an on-board computer system integrated with the HMD 110, a mobile device, or any other hardware platform capable of providing artificial reality content to and receiving inputs from users.

Figure 1C:
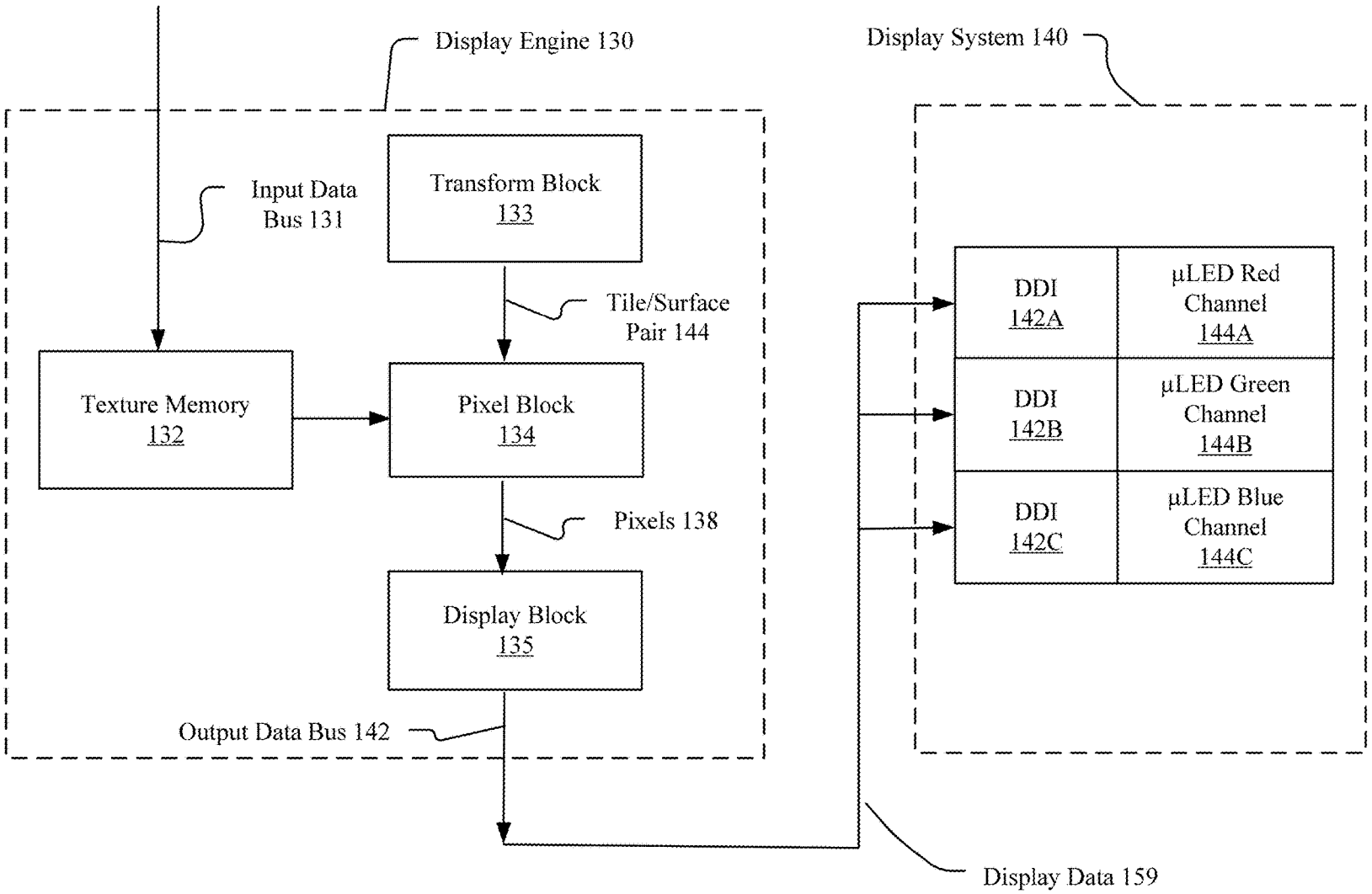
FIG. 1C illustrates an example architecture of a display engine.

FIG. 1C illustrates an example architecture 100C of a display engine 130. In particular embodiments, the processes and methods as described in this disclosure may be embodied or implemented within a display engine 130 (e.g., in the display block 135). The display engine 130 may include, for example, but is not limited to, a texture memory 132, a transform block 133, a pixel block 134, a display block 135, input data bus 131, output data bus 142, etc. In particular embodiments, the display engine 130 may include one or more graphic pipelines for generating images to be rendered on the display. For example, the display engine may use the graphic pipeline(s) to generate a series of subframe images based on a mainframe image and a viewpoint or view angle of the user as measured by one or more eye tracking sensors. The mainframe image may be generated or/and loaded in to the system at a mainframe rate of 30-90 Hz and the subframe rate may be generated at a subframe rate of 1-2 kHz. In particular embodiments, the display engine 130 may include two graphic pipelines for the user's left and right eyes. One of the graphic pipelines may include or may be implemented on the texture memory 132, the transform block 133, the pixel block 134, the display block 135, etc. The display engine 130 may include another set of transform block, pixel block, and display block for the other graphic pipeline. The graphic pipeline(s) may be controlled by a controller or control block (not shown) of the display engine 130. In particular embodiments, the texture memory 132 may be included within the control block or may be a memory unit external to the control block but local to the display engine 130. One or more of the components of the display engine 130 may be configured to communicate via a high-speed bus, shared memory, or any other suitable methods. This communication may include transmission of data as well as control signals, interrupts or/and other instructions. For example, the texture memory 132 may be configured to receive image data through the input data bus 211. As another example, the display block 135 may send the pixel values to the display system 140 through the output data bus 142. In particular embodiments, the display system 140 may include three color channels (e.g., 114A, 114B, 114C) with respective display driver ICs (DDIs) of 142A, 142B, and 143B. In particular embodiments, the display system 140 may include, for example, but is not limited to, light-emitting diode (LED) displays, organic light-emitting diode (OLED) displays, active matrix organic light-emitting diode (AMLED) displays, liquid crystal display (LCD), micro light-emitting diode (μLED) display, electroluminescent displays (ELDs), or any suitable displays.

In particular embodiments, the display engine 130 may include a controller block (not shown). The control block may receive data and control packages such as position data and surface information from controllers external to the display engine 130 though one or more data buses. For example, the control block may receive input stream data from a body wearable computing system. The input data stream may include a series of mainframe images generated at a mainframe rate of 30-90 Hz. The input stream data including the mainframe images may be converted to the required format and stored into the texture memory 132. In particular embodiments, the control block may receive input from the body wearable computing system and initialize the graphic pipelines in the display engine to prepare and finalize the image data for rendering on the display. The data and control packets may include information related to, for example, one or more surfaces including texel data, position data, and additional rendering instructions. The control block may distribute data as needed to one or more other blocks of the display engine 130. The control block may initiate the graphic pipelines for processing one or more frames to be displayed. In particular embodiments, the graphic pipelines for the two eye display systems may each include a control block or share the same control block.

In particular embodiments, the transform block 133 may determine initial visibility information for surfaces to be displayed in the artificial reality scene. In general, the transform block 133 may cast rays from pixel locations on the screen and produce filter commands (e.g., filtering based on bilinear or other types of interpolation techniques) to send to the pixel block 134. The transform block 133 may perform ray casting from the current viewpoint of the user (e.g., determined using the headset's inertial measurement units, eye tracking sensors, and/or any suitable tracking/localization algorithms, such as simultaneous localization and mapping (SLAM)) into the artificial scene where surfaces are positioned and may produce tile/surface pairs 144 to send to the pixel block 134. In particular embodiments, the transform block 133 may include a four-stage pipeline as follows. A ray caster may issue ray bundles corresponding to arrays of one or more aligned pixels, referred to as tiles (e.g., each tile may include 16×16 aligned pixels). The ray bundles may be warped, before entering the artificial reality scene, according to one or more distortion meshes. The distortion meshes may be configured to correct geometric distortion effects stemming from, at least, the eye display systems the headset system. The transform block 133 may determine whether each ray bundle intersects with surfaces in the scene by comparing a bounding box of each tile to bounding boxes for the surfaces. If a ray bundle does not intersect with an object, it may be discarded. After the tile-surface intersections are detected, the corresponding tile/surface pairs may be passed to the pixel block 134.

In particular embodiments, the pixel block 134 may determine color values or grayscale values for the pixels based on the tile-surface pairs. The color values for each pixel may be sampled from the texel data of surfaces received and stored in texture memory 132. The pixel block 134 may receive tile-surface pairs from the transform block 133 and may schedule bilinear filtering using one or more filer blocks. For each tile-surface pair, the pixel block 134 may sample color information for the pixels within the tile using color values corresponding to where the projected tile intersects the surface. The pixel block 134 may determine pixel values based on the retrieved texels (e.g., using bilinear interpolation). In particular embodiments, the pixel block 134 may process the red, green, and blue color components separately for each pixel. In particular embodiments, the display may include two pixel blocks for the two eye display systems. The two pixel blocks of the two eye display systems may work independently and in parallel with each other. The pixel block 134 may then output its color determinations (e.g., pixels 138) to the display block 135. In particular embodiments, the pixel block 134 may composite two or more surfaces into one surface to when the two or more surfaces have overlapping areas. A composed surface may need less computational resources (e.g., computational units, memory, power, etc.) for the resampling process.

In particular embodiments, the display block 135 may receive pixel color values from the pixel block 134, covert the format of the data to be more suitable for the scanline output of the display, apply one or more brightness corrections to the pixel color values, and prepare the pixel color values for output to the display. In particular embodiments, the display block 135 may each include a row buffer and may process and store the pixel data received from the pixel block 134. The pixel data may be organized in quads (e.g., 2×2 pixels per quad) and tiles (e.g., 16×16 pixels per tile). The display block 135 may convert tile-order pixel color values generated by the pixel block 134 into scanline or row-order data, which may be required by the physical displays. The brightness corrections may include any required brightness correction, gamma mapping, and dithering. The display block 135 may output the corrected pixel color values directly to the driver of the physical display (e.g., pupil display) or may output the pixel values to a block external to the display engine 130 in a variety of formats. For example, the eye display systems of the headset system may include additional hardware or software to further customize backend color processing, to support a wider interface to the display, or to optimize display speed or fidelity.

In particular embodiments, the dithering methods and processes (e.g., spatial dithering method, temporal dithering methods, and spatio-temporal methods) as described in this disclosure may be embodied or implemented in the display block 135 of the display engine 130. In particular embodiments, the display block 135 may include a model-based dithering algorithm or a dithering model for each color channel and send the dithered results of the respective color channels to the respective display driver ICs (e.g., 142A, 142B, 142C) of display system 140. In particular embodiments, before sending the pixel values to the respective display driver ICs (e.g., 142A, 142B, 142C), the display block 135 may further include one or more algorithms for correcting, for example, pixel non-uniformity, LED non-ideality, waveguide non-uniformity, display defects (e.g., dead pixels), etc.

In particular embodiments, graphics applications (e.g., games, maps, content-providing apps, etc.) may build a scene graph, which is used together with a given view position and point in time to generate primitives to render on a GPU or display engine. The scene graph may define the logical and/or spatial relationship between objects in the scene. In particular embodiments, the display engine 130 may also generate and store a scene graph that is a simplified form of the full application scene graph. The simplified scene graph may be used to specify the logical and/or spatial relationships between surfaces (e.g., the primitives rendered by the display engine 130, such as quadrilaterals or contours, defined in 3D space, that have corresponding textures generated based on the mainframe rendered by the application). Storing a scene graph allows the display engine 130 to render the scene to multiple display frames and to adjust each element in the scene graph for the current viewpoint (e.g., head position), the current object positions (e.g., they could be moving relative to each other) and other factors that change per display frame. In addition, based on the scene graph, the display engine 130 may also adjust for the geometric and color distortion introduced by the display subsystem and then composite the objects together to generate a frame. Storing a scene graph allows the display engine 130 to approximate the result of doing a full render at the desired high frame rate, while actually running the GPU or display engine 130 at a significantly lower rate.

Figure 1D:
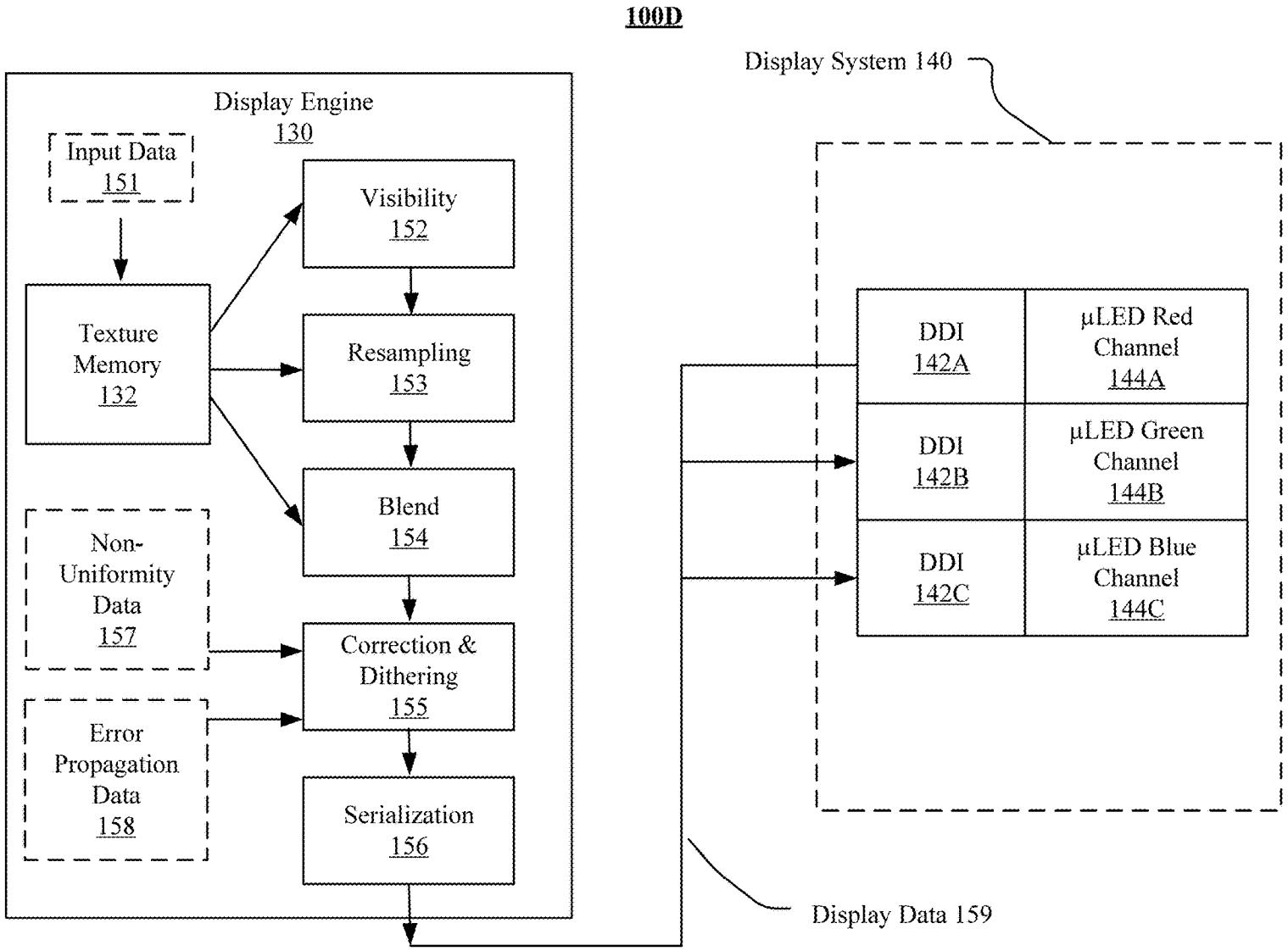
FIG. 1D illustrates an example graphic pipeline of the display engine for generating display image data.

FIG. 1D illustrates an example graphic pipeline 100D of the display engine 130 for generating display image data. In particular embodiments, the graphic pipeline 100D may include a visibility step 152, where the display engine 130 may determine the visibility of one or more surfaces received from the body wearable computing system. The visibility step 152 may be performed by the transform block (e.g., 2133 in FIG. 1C) of the display engine 130. The display engine 130 may receive (e.g., by a control block or a controller) input data 151 from the body-wearable computing system. The input data 151 may include one or more surfaces, texel data, position data, RGB data, and rendering instructions from the body wearable computing system. The input data 151 may include mainframe images with 30-90 frames per second (FPS). The main frame image may have color depth of, for example, 24 bits per pixel. The display engine 130 may process and save the received input data 151 in the texel memory 132. The received data may be passed to the transform block 133 which may determine the visibility information for surfaces to be displayed. The transform block 133 may cast rays for pixel locations on the screen and produce filter commands (e.g., filtering based on bilinear or other types of interpolation techniques) to send to the pixel block 134. The transform block 133 may perform ray casting from the current viewpoint of the user (e.g., determined using the headset's inertial measurement units, eye trackers, and/or any suitable tracking/localization algorithms, such as simultaneous localization and mapping (SLAM)) into the artificial scene where surfaces are positioned and produce surface-tile pairs to send to the pixel block 134.

In particular embodiments, the graphic pipeline 100D may include a resampling step 153, where the display engine 130 may determine the color values from the tile-surfaces pairs to produce pixel color values. The resampling step 153 may be performed by the pixel block 134 in FIG. 1C) of the display engine 130. The pixel block 134 may receive tile-surface pairs from the transform block 133 and may schedule bilinear filtering. For each tile-surface pair, the pixel block 134 may sample color information for the pixels within the tile using color values corresponding to where the projected tile intersects the surface. The pixel block 134 may determine pixel values based on the retrieved texels (e.g., using bilinear interpolation) and output the determined pixel values to the respective display block 135.

In particular embodiments, the graphic pipeline 100D may include a bend step 154, a correction and dithering step 155, a serialization step 156, etc. In particular embodiments, the bend step, correction and dithering step, and serialization steps of 154, 155, and 156 may be performed by the display block (e.g., 135 in FIG. 1C) of the display engine 130. The display engine 130 may blend the display content for display content rendering, apply one or more brightness corrections to the pixel color values, perform one or more dithering algorithms for dithering the quantization errors both spatially and temporally, serialize the pixel values for scanline output for the physical display, and generate the display data 159 suitable for the display system 140. The display engine 130 may send the display data 159 to the display system 140. In particular embodiments, the display system 140 may include three display driver ICs (e.g., 142A, 142B, 142C) for the pixels of the three color channels of RGB (e.g., 144A, 144B, 144C).

Figure 2A:
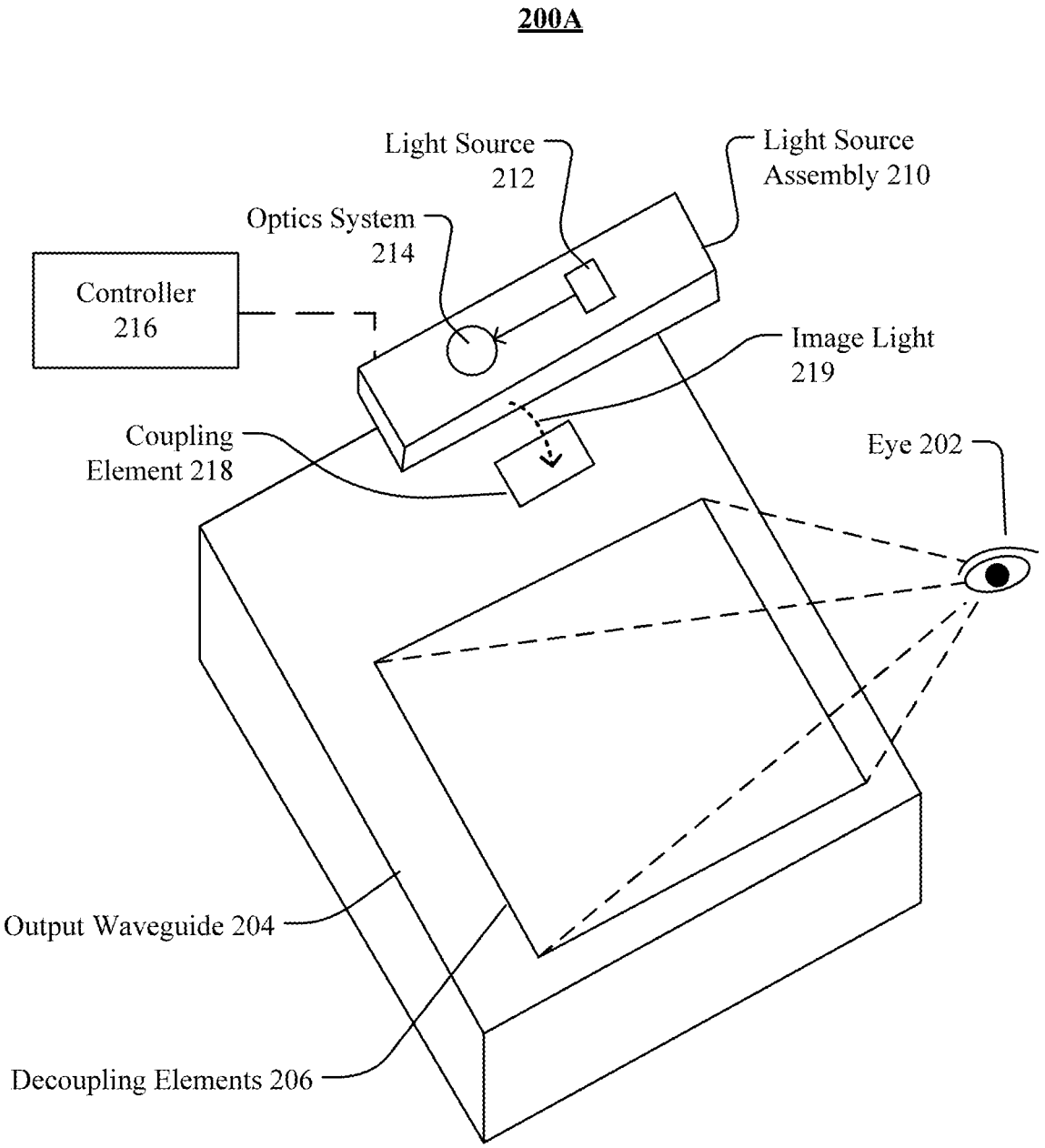
FIG. 2A illustrates an example scanning waveguide display.
Figure 3A:
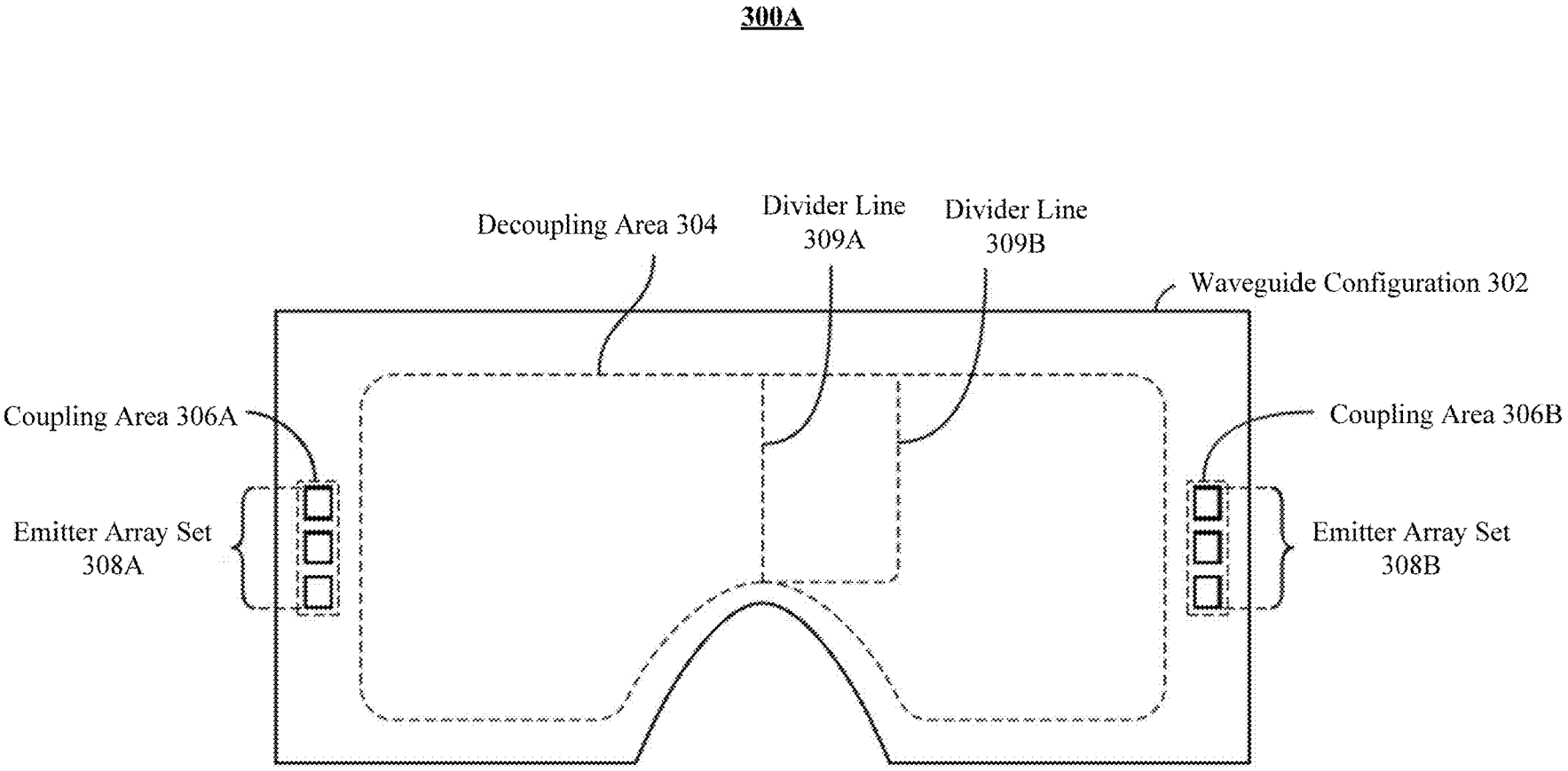
FIG. 3A illustrates an example 2D micro-LED waveguide display.

FIG. 2A illustrates an example scanning waveguide display 200A. In particular embodiments, the head-mounted display (HMD) of the AR/VR system may include a near eye display (NED) which may be a scanning waveguide display 200A. The scanning waveguide display 200A may include a light source assembly 210, an output waveguide 204, a controller 216, etc. The scanning waveguide display 200A may provide images for both eyes or for a single eye. For purposes of illustration, FIG. 3A shows the scanning waveguide display 200A associated with a single eye 202. Another scanning waveguide display (not shown) may provide image light to the other eye of the user and the two scanning waveguide displays may share one or more components or may be separated. The light source assembly 210 may include a light source 212 and an optics system 214. The light source 212 may include an optical component that could generate image light using an array of light emitters. The light source 212 may generate image light including, for example, but not limited to, red image light, blue image light, green image light, infra-red image light, etc. The optics system 214 may perform a number of optical processes or operations on the image light generated by the light source 212. The optical processes or operations performed by the optics systems 214 may include, for example, but are not limited to, light focusing, light combining, light conditioning, scanning, etc.

In particular embodiments, the optics system 214 may include a light combining assembly, a light conditioning assembly, a scanning mirror assembly, etc. The light source assembly 210 may generate and output an image light 219 to a coupling element 218 of the output waveguide 204. The output waveguide 204 may be an optical waveguide that could output image light to the user eye 202. The output waveguide 204 may receive the image light 219 at one or more coupling elements 218 and guide the received image light to one or more decoupling elements 206. The coupling element 218 may be, for example, but is not limited to, a diffraction grating, a holographic grating, any other suitable elements that can couple the image light 219 into the output waveguide 204, or a combination thereof. As an example and not by way of limitation, if the coupling element 350 is a diffraction grating, the pitch of the diffraction grating may be chosen to allow the total internal reflection to occur and the image light 219 to propagate internally toward the decoupling element 206. The pitch of the diffraction grating may be in the range of 300 nm to 600 nm. The decoupling element 206 may decouple the total internally reflected image light from the output waveguide 204. The decoupling element 206 may be, for example, but is not limited to, a diffraction grating, a holographic grating, any other suitable element that can decouple image light out of the output waveguide 204, or a combination thereof. As an example and not by way of limitation, if the decoupling element 206 is a diffraction grating, the pitch of the diffraction grating may be chosen to cause incident image light to exit the output waveguide 204. The orientation and position of the image light exiting from the output waveguide 204 may be controlled by changing the orientation and position of the image light 219 entering the coupling element 218. The pitch of the diffraction grating may be in the range of 300 nm to 600 nm.

In particular embodiments, the output waveguide 204 may be composed of one or more materials that can facilitate total internal reflection of the image light 219. The output waveguide 204 may be composed of one or more materials including, for example, but not limited to, silicon, plastic, glass, polymers, or some combination thereof. The output waveguide 204 may have a relatively small form factor. As an example and not by way of limitation, the output waveguide 204 may be approximately 50 mm wide along X-dimension, 30 mm long along Y-dimension and 0.5-1 mm thick along Z-dimension. The controller 216 may control the scanning operations of the light source assembly 210. The controller 216 may determine scanning instructions for the light source assembly 210 based at least on the one or more display instructions for rendering one or more images. The display instructions may include an image file (e.g., bitmap) and may be received from, for example, a console or computer of the AR/VR system. Scanning instructions may be used by the light source assembly 210 to generate image light 219. The scanning instructions may include, for example, but are not limited to, an image light source type (e.g., monochromatic source, polychromatic source), a scanning rate, a scanning apparatus orientation, one or more illumination parameters, or some combination thereof. The controller 216 may include a combination of hardware, software, firmware, or any suitable components supporting the functionality of the controller 216.

Figure 2B:
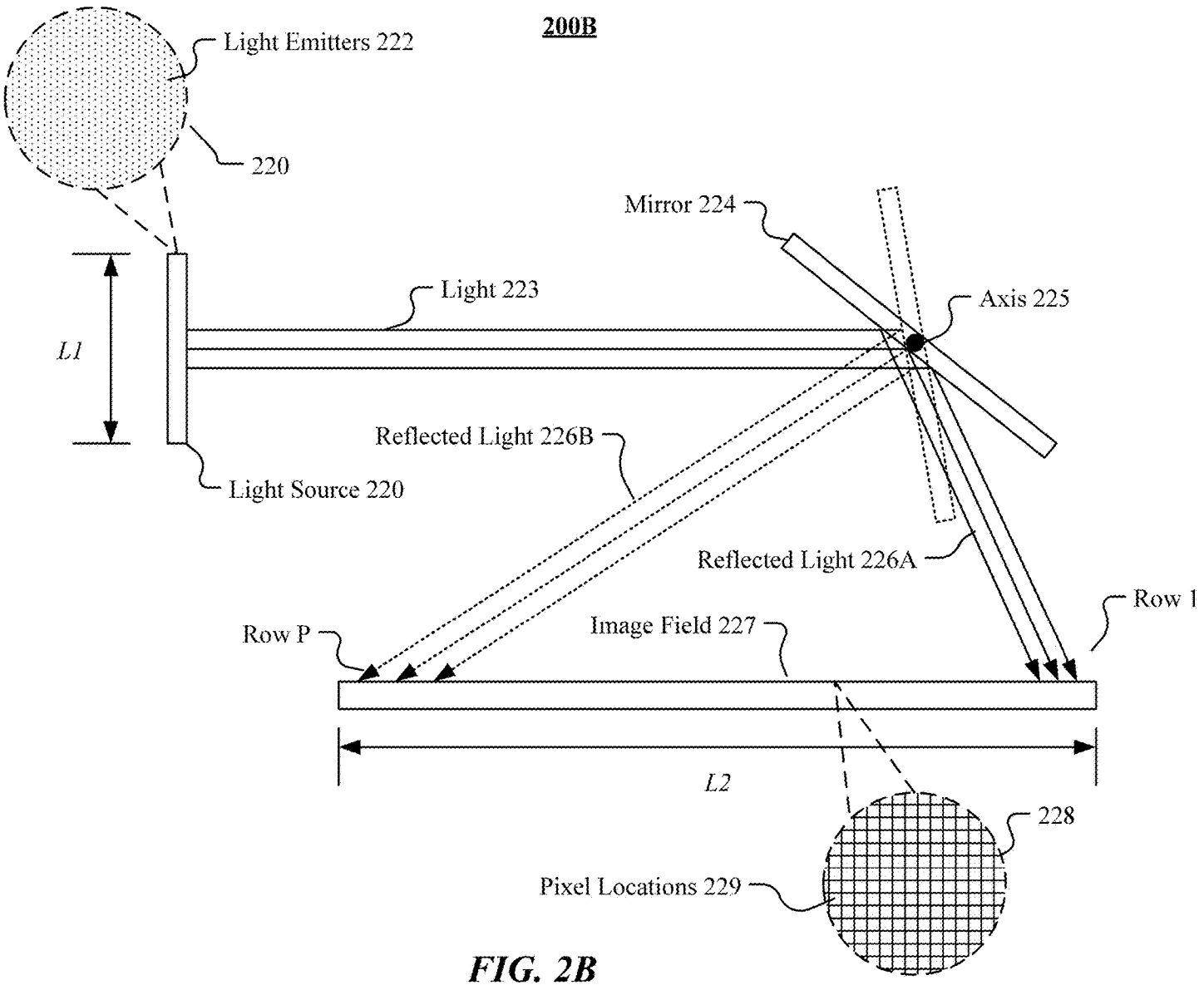
FIG. 2B illustrates an example scanning operation of the scanning waveguide display.

FIG. 2B illustrates an example scanning operation of a scanning waveguide display 200B. The light source 220 may include an array of light emitters 222 (as represented by the dots in inset) with multiple rows and columns. The light 223 emitted by the light source 220 may include a set of collimated beams of light emitted by each column of light emitters 222. Before reaching the mirror 224, the light 223 may be conditioned by different optical devices such as the conditioning assembly (not shown). The mirror 224 may reflect and project the light 223 from the light source 220 to the image field 227 by rotating about an axis 225 during scanning operations. The mirror 224 may be a microelectromechanical system (MEMS) mirror or any other suitable mirror. As the mirror 224 rotates about the axis 225, the light 223 may be projected to a different part of the image field 227, as illustrated by the reflected part of the light 226A in solid lines and the reflected part of the light 226B in dash lines.

In particular embodiments, the image field 227 may receive the light 226A-B as the mirror 224 rotates about the axis 225 to project the light 226A-B in different directions. For example, the image field 227 may correspond to a portion of the coupling element 218 or a portion of the decoupling element 206 in FIG. 2A. In particular embodiments, the image field 227 may include a surface of the coupling element 206. The image formed on the image field 227 may be magnified as light travels through the output waveguide 220. In particular embodiments, the image field 227 may not include an actual physical structure but include an area to which the image light is projected to form the images. The image field 227 may also be referred to as a scan field. When the light 223 is projected to an area of the image field 227, the area of the image field 227 may be illuminated by the light 223. The image field 227 may include a matrix of pixel locations 229 (represented by the blocks in inset 228) with multiple rows and columns. The pixel location 229 may be spatially defined in the area of the image field 227 with a pixel location corresponding to a single pixel. In particular embodiments, the pixel locations 229 (or the pixels) in the image field 227 may not include individual physical pixel elements. Instead, the pixel locations 229 may be spatial areas that are defined within the image field 227 and divide the image field 227 into pixels. The sizes and locations of the pixel locations 229 may depend on the projection of the light 223 from the light source 220. For example, at a given rotation angle of the mirror 224, light beams emitted from the light source 220 may fall on an area of the image field 227. As such, the sizes and locations of pixel locations 229 of the image field 227 may be defined based on the location of each projected light beam. In particular embodiments, a pixel location 229 may be subdivided spatially into subpixels (not shown). For example, a pixel location 229 may include a red subpixel, a green subpixel, and a blue subpixel. The red, green and blue subpixels may correspond to respective locations at which one or more red, green and blue light beams are projected. In this case, the color of a pixel may be based on the temporal and/or spatial average of the pixel's subpixels.

In particular embodiments, the light emitters 222 may illuminate a portion of the image field 227 (e.g., a particular subset of multiple pixel locations 229 on the image field 227) with a particular rotation angle of the mirror 224. In particular embodiment, the light emitters 222 may be arranged and spaced such that a light beam from each of the light emitters 222 is projected on a corresponding pixel location 229. In particular embodiments, the light emitters 222 may include a number of light-emitting elements (e.g., micro-LEDs) to allow the light beams from a subset of the light emitters 222 to be projected to a same pixel location 229. In other words, a subset of multiple light emitters 222 may collectively illuminate a single pixel location 229 at a time. As an example and not by way of limitation, a group of light emitter including eight light-emitting elements may be arranged in a line to illuminate a single pixel location 229 with the mirror 224 at a given orientation angle.

In particular embodiments, the number of rows and columns of light emitters 222 of the light source 220 may or may not be the same as the number of rows and columns of the pixel locations 229 in the image field 227. In particular embodiments, the number of light emitters 222 in a row may be equal to the number of pixel locations 229 in a row of the image field 227 while the light emitters 222 may have fewer columns than the number of pixel locations 229 of the image field 227. In particular embodiments, the light source 220 may have the same number of columns of light emitters 222 as the number of columns of pixel locations 229 in the image field 227 but fewer rows. As an example and not by way of limitation, the light source 220 may have about 1280 columns of light emitters 222 which may be the same as the number of columns of pixel locations 229 of the image field 227, but only a handful rows of light emitters 222. The light source 220 may have a first length L1 measured from the first row to the last row of light emitters 222. The image field 530 may have a second length L2, measured from the first row (e.g., Row 1) to the last row (e.g., Row P) of the image field 227. The L2 may be greater than L1 (e.g., L2 is 50 to 10,000 times greater than L1).

In particular embodiments, the number of rows of pixel locations 229 may be larger than the number of rows of light emitters 222. The display device 200B may use the mirror 224 to project the light 223 to different rows of pixels at different time. As the mirror 520 rotates and the light 223 scans through the image field 227, an image may be formed on the image field 227. In some embodiments, the light source 220 may also has a smaller number of columns than the image field 227. The mirror 224 may rotate in two dimensions to fill the image field 227 with light, for example, using a raster-type scanning process to scan down the rows then moving to new columns in the image field 227. A complete cycle of rotation of the mirror 224 may be referred to as a scanning period which may be a predetermined cycle time during which the entire image field 227 is completely scanned. The scanning of the image field 227 may be determined and controlled by the mirror 224 with the light generation of the display device 200B being synchronized with the rotation of the mirror 224. As an example and not by way of limitation, the mirror 224 may start at an initial position projecting light to Row 1 of the image field 227, and rotate to the last position that projects light to Row P of the image field 227, and then rotate back to the initial position during one scanning period. An image (e.g., a frame) may be formed on the image field 227 per scanning period. The frame rate of the display device 200B may correspond to the number of scanning periods in a second. As the mirror 224 rotates, the light may scan through the image field to form images. The actual color value and light intensity or brightness of a given pixel location 229 may be a temporal sum of the color various light beams illuminating the pixel location during the scanning period. After completing a scanning period, the mirror 224 may revert back to the initial position to project light to the first few rows of the image field 227 with a new set of driving signals being fed to the light emitters 222. The same process may be repeated as the mirror 224 rotates in cycles to allow different frames of images to be formed in the scanning field 227.

Figure 3B:
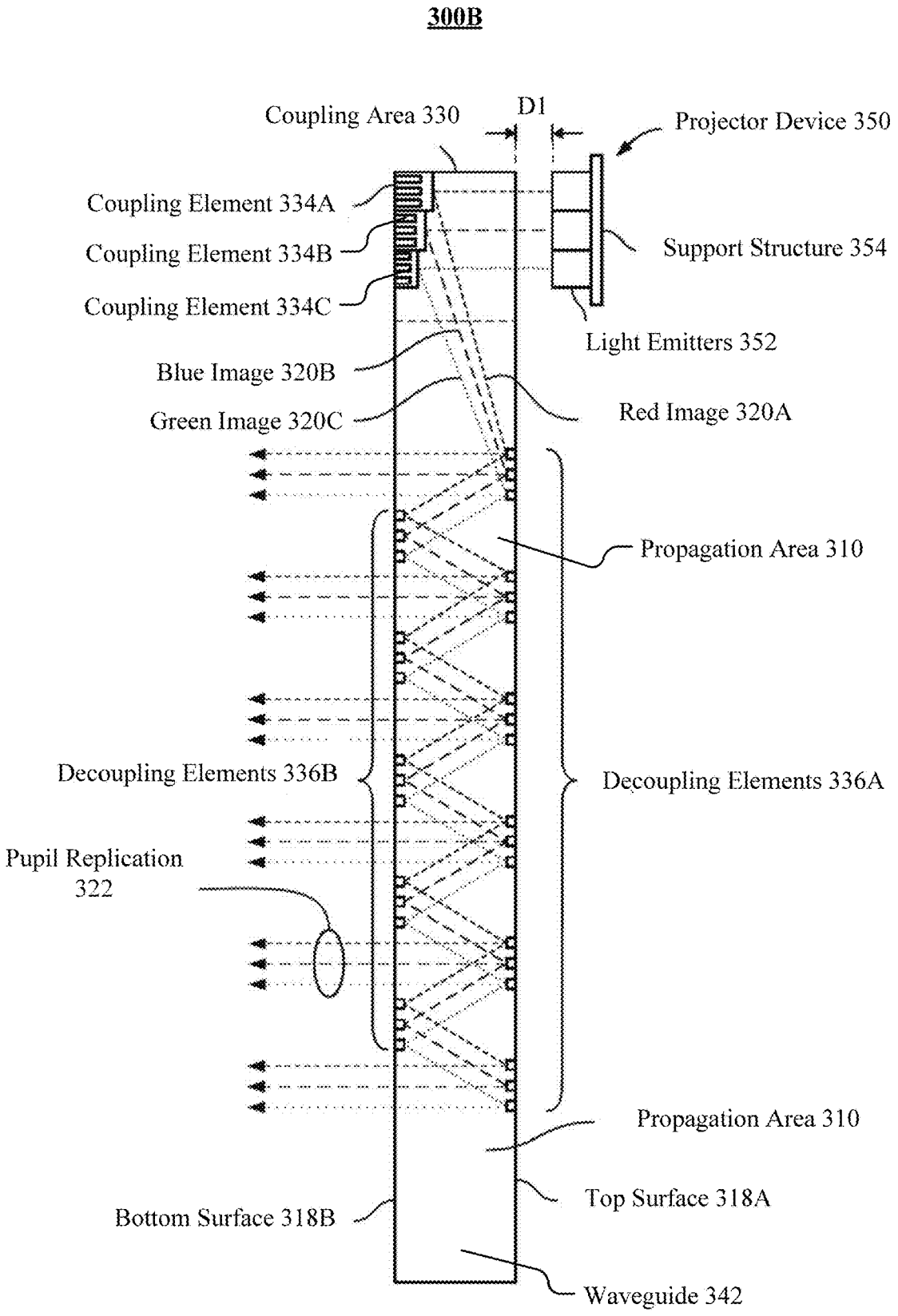
FIG. 3B illustrates an example waveguide configuration for the 2D micro-LED waveguide display.

FIG. 3A illustrates an example 2D micro-LED waveguide display 300A. In particular embodiments, the display 300A may include an elongate waveguide configuration 302 that may be wide or long enough to project images to both eyes of a user. The waveguide configuration 302 may include a decoupling area 304 covering both eyes of the user. In order to provide images to both eyes of the user through the waveguide configuration 302, multiple coupling areas 306A-B may be provided in a top surface of the waveguide configuration 302. The coupling areas 306A and 306B may include multiple coupling elements to receive image light from light emitter array sets 308A and 308B, respectively. Each of the emitter array sets 308A-B may include a number of monochromatic emitter arrays including, for example, but not limited to, a red emitter array, a green emitter array, and a blue emitter array. In particular embodiments, the emitter array sets 308A-B may further include a white emitter array or an emitter array emitting other colors or any combination of any multiple colors. In particular embodiments, the waveguide configuration 302 may have the emitter array sets 308A and 308B covering approximately identical portions of the decoupling area 304 as divided by the divider line 309A. In particular embodiments, the emitter array sets 308A and 308B may provide images to the waveguide of the waveguide configuration 302 asymmetrically as divided by the divider line 309B. For example, the emitter array set 308A may provide image to more than half of the decoupling area 304. In particular embodiments, the emitter array sets 308A and 308B may be arranged at opposite sides (e.g., 180° apart) of the waveguide configuration 302 as shown in FIG. 3B. In other embodiments, the emitter array sets 308A and 308B may be arranged at any suitable angles. The waveguide configuration 302 may be planar or may have a curved cross-sectional shape to better fit to the face/head of a user.

FIG. 3B illustrates an example waveguide configuration 300B for the 2D micro-LED waveguide display. In particular embodiments, the waveguide configuration 300B may include a projector device 350 coupled to a waveguide 342. The projector device 320 may include a number of light emitters 352 (e.g., monochromatic emitters) secured to a support structure 354 (e.g., a printed circuit board or other suitable support structure). The waveguide 342 may be separated from the projector device 350 by an air gap having a distance of D1 (e.g., approximately 50 μm to approximately 500 μm). The monochromatic images projected by the projector device 350 may pass through the air gap toward the waveguide 342. The waveguide 342 may be formed from a glass or plastic material. The waveguide 342 may include a coupling area 330 including a number of coupling elements 334A-C for receiving the emitted light from the projector device 350. The waveguide 342 may include a decoupling area with a number of decoupling elements 336A on the top surface 318A and a number of decoupling elements 336B on the bottom surface 318B. The area within the waveguide 342 in between the decoupling elements 336A and 336B may be referred as a propagation area 310, in which image light received from the projector device 350 and coupled into the waveguide 342 by the coupling element 334 may propagate laterally within the waveguide 342.

The coupling area 330 may include coupling elements (e.g., 334A, 334B, 334C) configured and dimensioned to couple light of predetermined wavelengths (e.g., red, green, blue). When a white light emitter array is included in the projector device 350, the portion of the white light that falls in the predetermined wavelengths may be coupled by each of the coupling elements 334A-C. In particular embodiments, the coupling elements 334A-B may be gratings (e.g., Bragg gratings) dimensioned to couple a predetermined wavelength of light. In particular embodiments, the gratings of each coupling element may exhibit a separation distance between gratings associated with the predetermined wavelength of light and each coupling element may have different grating separation distances. Accordingly, each coupling element (e.g., 334A-C) may couple a limited portion of the white light from the white light emitter array of the projector device 350 if white light emitter array is included in the projector device 350. In particular embodiments, each coupling element (e.g., 334A-C) may have the same grating separation distance. In particular embodiments, the coupling elements 334A-C may be or include a multiplexed coupler.

As illustrated in FIG. 3B, a red image 320A, a blue image 320B, and a green image 320C may be coupled by the coupling elements 334A, 334B, 334C, respectively, into the propagation area 310 and may begin to traverse laterally within the waveguide 342. A portion of the light may be projected out of the waveguide 342 after the light contacts the decoupling element 336A for one-dimensional pupil replication, and after the light contacts both the decoupling elements 336A and 336B for two-dimensional pupil replication. In two-dimensional pupil replication, the light may be projected out of the waveguide 342 at locations where the pattern of the decoupling element 336A intersects the pattern of the decoupling element 336B. The portion of the light that is not projected out of the waveguide 342 by the decoupling element 336A may be reflected off the decoupling element 336B. The decoupling element 336B may reflect all incident light back toward the decoupling element 336A. Accordingly, the waveguide 342 may combine the red image 320A, the blue image 320B, and the green image 320C into a polychromatic image instance which may be referred as a pupil replication 322. The polychromatic pupil replication 322 may be projected to the user's eyes which may interpret the pupil replication 322 as a full color image (e.g., an image including colors addition to red, green, and blue). The waveguide 342 may produce tens or hundreds of pupil replication 322 or may produce a single replication 322.

In particular embodiments, the AR/VR system may use scanning waveguide displays or 2D micro-LED displays for displaying AR/VR content to users. In order to miniaturize the AR/VR system, the display system may need to miniaturize the space for pixel circuits and may have limited number of available bits for the display. The number of available bits in a display may limit the display's color depth or gray scale level, and consequently limit the quality of the displayed images. Furthermore, the waveguide displays used for AR/VR systems may have nonuniformity problem cross all display pixels. The compensation operations for pixel nonuniformity may result in loss on image grayscale and further reduce the quality of the displayed images. For example, a waveguide display with 8-bit pixels (i.e., 256 gray level) may equivalently have 6-bit pixels (i.e., 64 gray level) after compensation of the nonuniformity (e.g., 8:1 waveguide nonuniformity, 0.1% dead micro-LED pixel, and 20% micro-LED intensity nonuniformity).

To improve the displayed image quality, displays with limited color depth or gray scale level may use spatio dithering to spread quantization errors to neighboring pixels and generate the illusion of increased color depth or gray scale level. To further increase the color depth or gray scale level, displays may generate a series of temporal subframe images with less gray level bits to give the illusion of a target image which has more gray level bits. Each subframe image may be dithered using spatio dithering techniques within that subframe image. The average of the series of subframe image may correspond to the image as perceived by the viewer. For example, for display an image with 8-bit pixels (i.e., 256 gray level), the system may use four subframe images each having 6-bit pixels (i.e., 64 gray level) to represent the 8-bit target image. As another example, an image with 8-bit pixels (i.e., 256 gray level) may be represented by 16 subframe images each having 4-bit pixels (i.e., 16 gray level). This would allow the display system to render images of more gray level (e.g., 8-bit pixels) with pixel circuits and supporting hardware for less gray level (e.g., 6-bit pixels or 4-bit pixels), and therefore reduce the space and size of the display system.

Figure 4B:
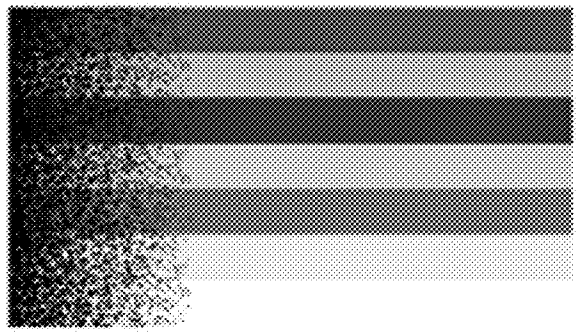
FIGS. 4B-D illustrate example subframe images generated using segmented quantization and spatio dithering method to represent the target image of FIG. 4A.
Figure 4D:
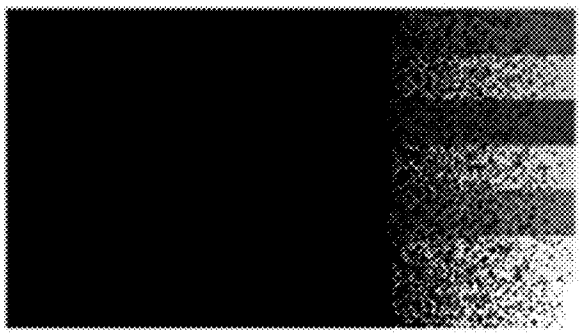
Figure 4A:
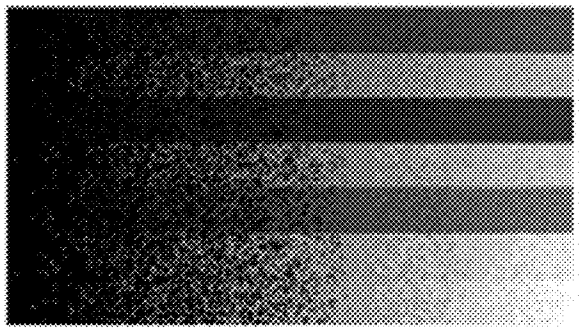
FIG. 4A illustrates an example target image to be represented by a series of subframe images with less color depth.
Figure 4C:
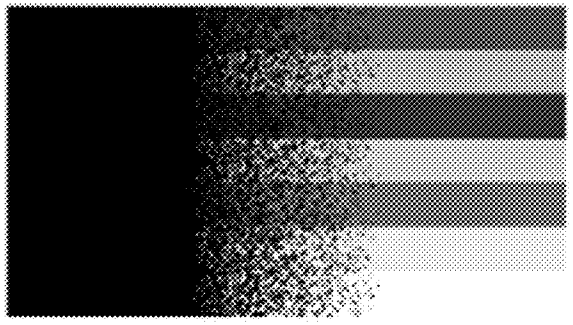

FIG. 4A illustrates an example target image 400A to be represented by a series of subframe images with less color depth. FIGS. 4B-D illustrate example subframe images 400B-D generated using segmented quantization and spatio dithering method to represent the target image 400A of FIG. 4A. The target image 400A may have more gray level bits than the physical display. The subframe images 400B-D may have gray level bits corresponding to the physical display, which is less than the target image 400A, and may be used to represent the target image using the time average as perceived by viewers. To generate each subframe image, the value of each pixel in the target image may be quantized according to a series of segmented value ranges corresponding to the weighted value ranges of the subframe images. Each subframe image may correspond to a segmented portion of the pixel range of the target image. The pixel value range of each subframe image may be weighted according to the corresponding segmented portion of the target image pixel range. As an example and not by way of limitation, the first, second and third subframes (as shown in FIGS. 4B-D, respectively) may cover the grayscale level ranges of [0, 1/3], [1/3, 2/3] and [2/3, 1] in the normalized grayscale level range of [0, 1]. Using this temporal stacking property, the temporal integrated noise related to the rendered images may be reduced by $1/N^2$ where N is the number of subframe images.

However, using this segmented quantization and spatio dithering method, even though the average luminance of the all subframe images over time is approximately equal to the target image, the subframes 400B-D may have very different luminance, as illustrated in FIGS. 4B-D. For example, the subframe image 400B capturing the lower energy bits may be very bright since most pixel value of the target image 400A may exceed the maximum pixel value of the subframe 400B. The subframe image 400D capturing the high energy bits may be very dim because most of the pixel value of the target image 400A may be below the pixel value range of the subframe 400D. This may work well for traditional displays such as LCD/LED displays since the user eyes do not change dramatically between the subframe images. However, it will create temporal artifacts such as flashes or uneven luminance over time in AR/VR system because the user's eyes and head positions may change dramatically between the subframe images while wearing AR/VR headset, and will negatively impact the quality of the displayed images and user experiences on the AR/VR system.

To solve the problem of un-even luminance of subframe images, particular embodiments of the system may use a spatio-temporal dithering method to generate a series of subframe images for representing a target image with more even luminance distribution across all subframe images. The spatio-temporal dithering method may dither quantization errors both spatially to neighboring pixels of the same subframe image and temporally to the corresponding pixel of next subframe image of the series of subframe images. The temporally dithered quantization error of a pixel of a subframe image may be dithered to the corresponding pixel in the next subframe image of the series of subframe images in the time domain. The system may generate each subframe image using spatial-temporal dithering methods. However, these dithering methods may need an error buffer to provide temporal feedback, and therefore use more memory. To reduce the memory usage related to processes of generating subframe images, particular embodiments of the system may use a number of dithering masks to generate the series of subframe images for representing a target image with even luminance distribution across all subframe images. The system may generate the subframe images using the corresponding dithering masks by comparing target grayscale values the threshold values of the corresponding dithering masks and dithering the quantization errors to other subframes without using an error buffer, as will be described in detail in later sections of this disclosure.

Figure 5A:
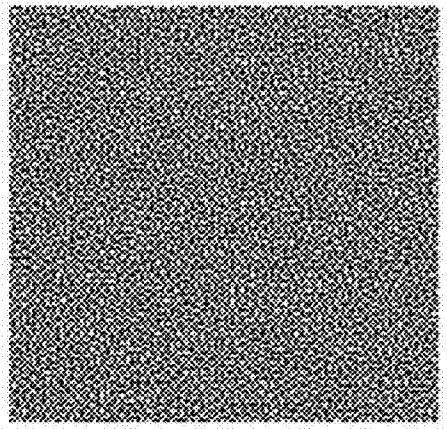
FIG. 5A illustrates an example dithering mask based on dot patterns with blue-noise properties and satisfying spatio stacking constraints.
Figure 5B:
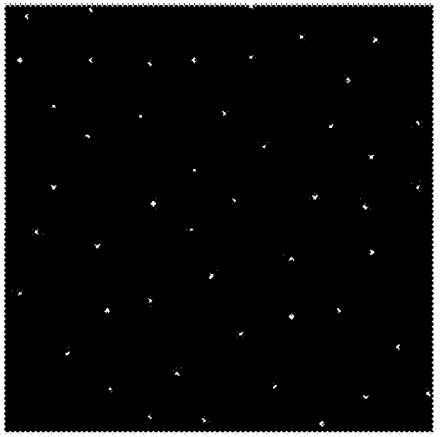
FIGS. 5B-D illustrate example dot patterns for grayscale level 1, 8, and 32 in a grayscale level range of [0, 255].
Figure 5C:
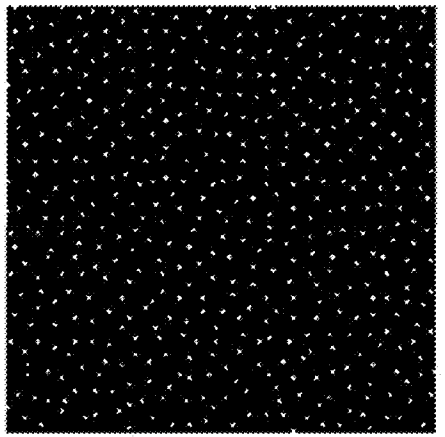
Figure 5D:
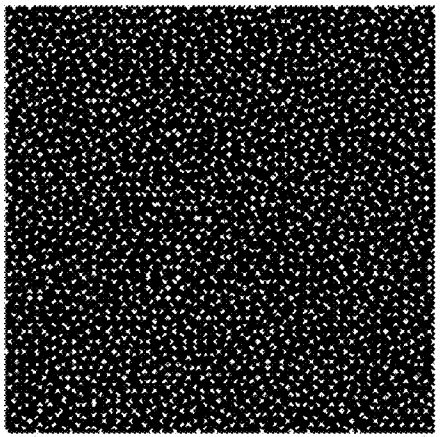

FIG. 5A illustrates an example dithering mask based on dot patterns with blue-noise properties and satisfying spatio stacking constraints. FIGS. 5B-D illustrate example dot patterns for grayscale level 1, 8, and 32 in the grayscale level range of [0, 255]. In particular embodiments, the system may generate spatio dithering masks based on dot patterns with blue-noise properties. The dithering mask may include a number of dot patterns with each dot pattern having a dot density corresponding to a grayscale level within the grayscale level range or the quantization range. A dot pattern for a higher grayscale level may have a higher dot density than a dot pattern for a lower grayscale level. The dot patterns may be chosen to have blue-noise properties (e.g., with the frequency spectrum being blue-noise weighted). The grayscale level range or the quantization range may be determined by the bit length of the display. For example, an 8-bit display may have a grayscale level range of [0, 255]. As another example, a 6-bit display may have a grayscale level range of [0, 63]. As another example, a 4-bit display may have a grayscale level range of [0~15]. In particular embodiments, the dot patterns of the dithering mask may have a spatial stacking property according to which a dot pattern of a grayscale level N may include all dot patterns of lower grayscale levels from 0 to N−1. For example, the dots in the dot pattern of grayscale level 1 (as shown in FIG. 5A) may be included in the dot pattern of grayscale level 8 (as shown in FIG. 5B) and in the dot pattern of grayscale level 32 (as shown in FIG. 5C). As another example, the dots in the dot pattern of grayscale level 8 (as shown in FIG. 5B) may be included in the dot pattern of the grayscale level 32 (as shown in FIG. 5C).

In particular embodiments, each dot in the dithering mask may correspond to a threshold value which equals to the lowest grayscale level allowing that dot to be turned on (i.e., the lowest grayscale level whose corresponding dot pattern includes that dot). From the lowest grayscale level to the highest grayscale level, once a dot is turned on (i.e., being included in a dot pattern of a grayscale level), the dot may stay the turn-on state for all higher grayscale levels (i.e., being included in the dot patterns of all higher grayscale levels). The spatio stacking properties of the dot patterns may allow all dot patterns to be encoded into one dithering mask. In particular embodiments, the dithering mask (e.g., 500A in FIG. 5A) may include all the dot patterns (which are spatially stacked together) corresponding to all grayscale levels of the quantization range which may correspond to the gray level bits of the display (e.g., [0, 255] for 8-bit display, [0, 63] for 6-bit display, [0, 15] for 3-bit display). The dithering mask (e.g., 500A in FIG. 5A) may have a third dimension for storing the threshold values associated with the respective dots. In particular embodiments, the threshold values stored in the dithering mask may be the actual grayscale level values (e.g., [0, 255] for 8-bit display). In particular embodiments, the threshold values stored in the dithering mask may be normalized grayscale level values (e.g., [0, 1] for any bit display). In this case, the threshold values may be determined by the normalized grayscale level range of [0, 1] and the number of grayscale levels (e.g., 255 for 8-bit display). For example, for an 8-bit display, the threshold values could be 0, 1/255, 2/255 . . . 8/255 . . . 32/255 . . . 255/255, etc. As another example, for a 3-bit display, the threshold values could be 0, 1/7, 2/7, . . . 7/7, etc.

In particular embodiments, for the quantization process, the system may compare a target grayscale value g to the threshold values associated with the dots in the dithering mask and determine the quantized grayscale value. For example, the system may select the closest threshold value (i.e., the closest grayscale level within the quantization range) in the dithering mask as the quantized grayscale value for the target grayscale value. Then, the system may determine the quantization error by comparing the quantized grayscale value with the target scale value. The system may dither the quantization error spatially to the nearby pixels or regions (e.g., tile regions) of the same subframe or/and temporally to the corresponding pixels or regions of other temporal subframes (e.g., corresponding pixels or region of the next subframe image). The system may determine display grayscale value based on the quantized grayscale value of the target grayscale value and the dithered quantization error to the pixels of the corresponding tile region the target grayscale value (e.g., dithered from the former subframe image or from neighboring tile region of the same subframe image). The system may a dot pattern corresponding to a grayscale level that is most close to the display grayscale value and use the selected dot pattern to represent the target grayscale value.

In particular embodiments, the process for dithering the quantization error may need an error buffer for propagating the quantization errors to other subframes. For example, the series of subframe images may be generated in a sequential order (e.g., from 1 to N). The quantization errors of the subframe n may be stored in an error buffer or a frame buffer (e.g., the same size as the subframe image) and may be dithered to the subframe n+1 during the generating process of the subframe n+1. It is notable that particular embodiments of the mask-based dithering method, as described in this disclosure, may not need to use the error buffer for prorogating the quantization errors to other subframes. Instead, for generating N number of subframe images, the system may generate N number of dithering masks. The dithering masks may be pre-determined or pre-generated (e.g., during an offline process) before the process for generating the subframe images. All N number of dithering masks may be available for being used to generate the subframe images at the same time. The system may use the N number of dithering masks to generate the N number of subframe images parallelly or/and essentially at the same time. The quantization errors of a subframe can be dithered to next subframe during the parallel subframe generating processes since they could be parallel or essentially at the same time. The temporal dithering process for dithering to next subframe and the spatial dithering process for dithering to neighboring pixels may be performed at essentially the same time during the subframe generating process. The system may not need to store the quantization errors in the error buffer, and therefore may reduce the memory and power usage during the subframe generating process. For example, the error buffer-based method may need an error buffer with a memory size of 6.6 Mbytes for the temporal dithering process for subframe images with 2560×1792 resolution, 4-bit grayscale level, and 3 color channels of RGB. The mask-based method may eliminate the needs for the error buffer or frame buffer, and therefore have less memory usage for the dithering process. Although the mask-based method may need N coupled dithering masks, the same dithering masks may be used for the three color channels of R, G and B. For example, for the subframe number N=16, the system may need 130 Kbytes memory for storing 16 subframe masks with each mask having 128×128 resolution and 4-bit grayscale levels (i.e., 130 Kbytes=128×128×4 bits×16 subframes), which is muss less than the error buffer size of 6.6 Mbytes. As another example, for the subframe number N=32, the system may need 260 Kbytes memory for storing 32 subframe masks with each mask having 128×128 resolution and 4-bit grayscale levels (i.e., 260 Kbytes=128×128×4 bits'32 subframes), which is muss less than the error buffer size of 6.6 Mbytes. Therefore, the mask-based dithering method may reduce the memory usage of the dithering process by 5-10 times comparing to the error buffer-based methods. In addition, the error buffer or frame buffer may need to be both writable and readable memory for the dithering operation to store and access the quantization errors during the dithering process. However, the mask-based dithering method may have fixed threshold values once after they are firstly determined and may store the masks (with fixed threshold values) in read-only memory units, which further improve the efficiency of the memory usage and reduce the power usage.

In particular embodiments, for generating N subframe images, the system may generate N coupled blue noise dithering masks that simultaneously satisfy both spatial and temporal stacking constraints and use the dithering masks to generate the subframe images. By using this approach, the system may generate subframes with high quality dithering and reduce the temporal integrated noise of the rendered images by $1/N^2$. This approach may have two attributes of spatial stacking property and temporal stacking property, simultaneously. The spatial stacking property, according to which the dot pattern for grayscale N may include all the dot patterns from grayscales 0 to N−1, may allow the generated subframes to have smooth dither pattern transition between grayscale levels. The temporal stacking property, according to which grayscale N rendered by the first subframe and grayscale N+1 rendered by the combination of the first subframe and second subframe may obey the stacking property, may allow the subframes to have minimal temporal change from one subframe to another subframe. All these advantages could be achieved without using an error buffer. Alternatively, the system may use N independently generated dithering masks for generating the N subframes with no temporal stacking property. However, the temporal integrated noise may only be reduced by 1/N by using the N independently generated dithering masks instead of using the N coupled blue noise dithering masks.

In particular embodiments, the system may use N dithering masks to generate N subframes for representing a target image (N can be any integer number). For determining a dot pattern for a target grayscale value (e.g., an average grayscale value a target tile region), the dot patterns corresponding to all lower grayscale levels may be spatially stacked to represent the target grayscale value. In particular embodiments, when the target grayscale value is below or equal to a grayscale limit $g_L$ (i.e., $g_L=g_{max}/N$, where $g_{max}$ is the maximum grayscale level and N is the number of subframes), the system may generate N dithering masks which have no overlapping dots between any two dithering masks. In other words, each dithering mask may include a different set of dots from any other dithering masks and the dots in all dithering masks when stacked together may correspond to all the pixels of the target image. Each dithering mask may include a dot pattern corresponding to the grayscale limit $g_L$. The system may consequently use the N non-overlapping dithering masks to generate N subframes which have no overlapping pixels between any two subframes. Therefore, the subframes may have a temporal stacking property which allows that all the pixels of the N subframes once stacked together to correspond to all the pixels in the target image. As a result, the subframes may have more even luminance and more uniform display results for representing the target image.

In particular embodiments, the system may determine a grayscale limit $g_L$ for non-overlapping dithering masks by dividing the maximum grayscale level (e.g., 1) within a grayscale range (e.g., [0, 1]) by the number of subframes N (i.e., $g_L=g_{max}/N$, where $g_{max}$ is the maximum grayscale level). For example, with the maximum grayscale level of 1 and the number of subframes of 4, the grayscale limit for non-overlapping dithering masks may be determined to 0.25. As another example, with the maximum grayscale level of 1 and the number of subframe of 10, the grayscale limit for non-overlapping dithering mask may be determined to be 0.1. As another example, with the maximum grayscale level of 1 and the number of subframe of 16, the grayscale limit for non-overlapping dithering mask may be determined to be 1/16.

Figure 6A:
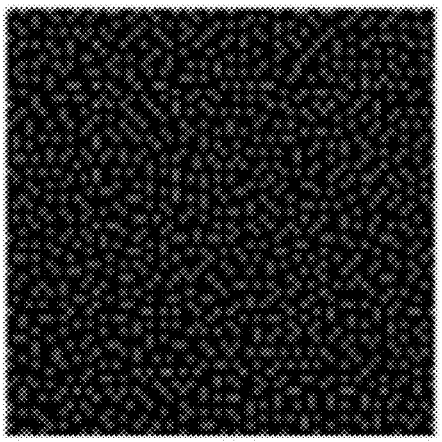
FIGS. 6A-D illustrate example dot patterns of four dithering masks for generating temporal subframe images satisfying spatio and temporal stacking constraints.
Figure 6B:
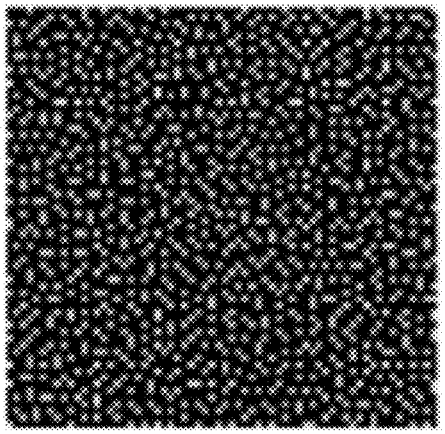
Figure 6C:
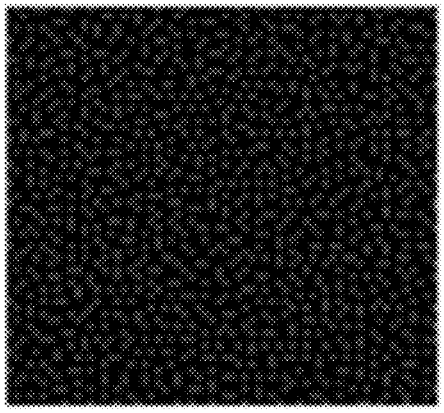
Figure 6D:
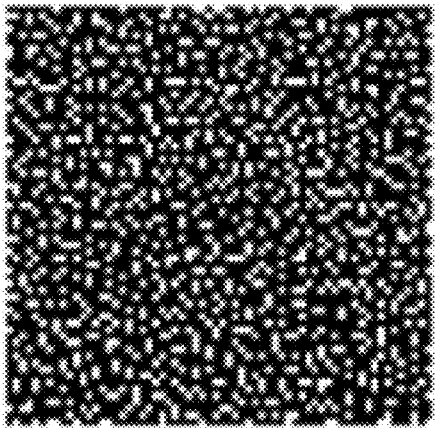
Figure 6E:
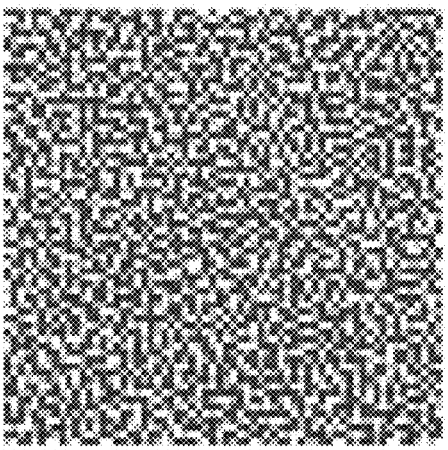
FIG. 6E illustrates a dot pattern generated by stacking the dot patterns of the four dithering masks as shown in FIGS. 6A-D.
Figure 7A:
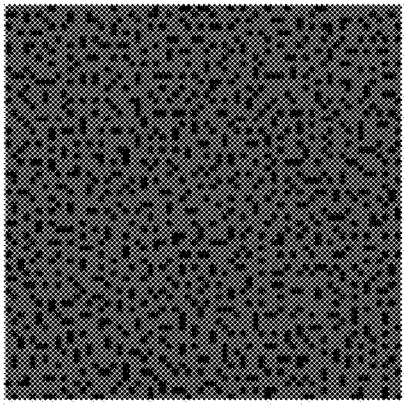
FIGS. 7A-D illustrate four example dithering masks satisfying both spatio and temporal stacking constraints.
Figure 7B:
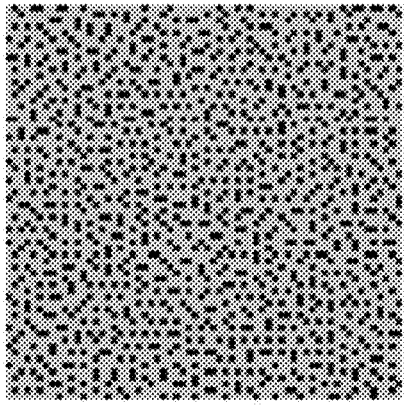
Figure 7C:
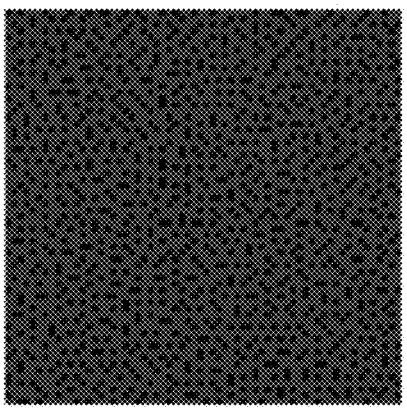
Figure 7D:
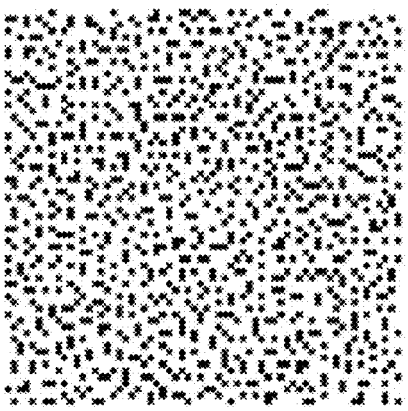

FIGS. 6A-D illustrate example dot patterns of four dithering masks 600A-D for generating temporal subframe images satisfying spatio and temporal stacking constraints. FIG. 6E illustrates an example dot pattern generated by stacking the dot patterns of the four dithering masks 600A-D as shown in FIGS. 6A-D. In particular embodiments, a target image may be represented by a series of subframe images including N subframes. As an example and not by way of limitation, the system may use 4 subframes to represent a target image. For each subframe, the system may generate a dithering mask (e.g., 600A, 600B, 600C, 600D) which has a dot pattern corresponding to a grayscale limit of 0.25. Each dithering mask may have a spatial stacking property according to which the dot pattern of the dithering mask (e.g., corresponding to grayscale level of 0.25) may include all dot patterns of lower grayscale levels (e.g., 0<=g<0.25). The four dithering masks may be chosen to have blue-noise properties and may have no overlapping dots with each other. In other words, the four dithering masks of 600A-D may each include a unique set of dots. Therefore, the four dithering masks of 600A-D may have a temporal stacking property according to which the dots of the four dithering masks once stacked together may correspond to all pixels of the target region of the target image (as shown in FIG. 6A). The relationship of the non-overlapping dot patterns of the four dithering masks 600A-D may be described by the following equations:

$$G_1 \not\supset (G_2 \cup G_3 \cup G_4) \quad (1)$$

$$G_2 \not\supset (G_1 \cup G_3 \cup G_4) \quad (2)$$

$$G_3 \not\supset (G_1 \cup G_2 \cup G_4) \quad (3)$$

$$G_4 \not\supset (G_1 \cup G_2 \cup G_3) \quad (4)$$

$$G_1 \cup G_2 \cup G_3 \cup G_4) = 1 \quad (5)$$

where $G_1$, $G_2$, $G_3$, and $G_4$ are the dot set of the first, second, third and fourth dithering mask, respectively. In other words, each dithering mask may have no overlapping dots with any other dithering masks and the combination of all dithering mask may correspond to all the pixels of the target image region.

In particular embodiments, the dot patterns of the dithering masks with blue-noise properties may be generated using a simulated annealing algorithm. When the target grayscale value is smaller than the grayscale limit of 0.25, the four subframe images may be generated by applying the four dithering masks as shown in FIGS. 6A-D to the target image. As a result, the four subframe images may have both spatial stacking property and temporal stacking property as defined by the dithering masks. For example, for each of the four subframe images, the dot pattern representing a target grayscale value may include all the dot patterns corresponding to the lower grayscale levels. The four subframe images may include different set of pixels from each other and the sum (e.g., by staking the four subframe images together) of four subframe images may correspond to all pixels of the target images. In particular embodiments, the target grayscale value may be an average grayscale value of a target image region such as a tile region. A target image may include a number of target regions (e.g., tile regions). The process for generating the subframe images may include applying the dithering mask for a subframe image to each target region. It is notable that the subframe number N=4 is used as an example and the number of subframes is not limited to N=4 and can by any suitable integer number. The systems and methods described in this disclosure may be applicable to any N number of subframes.

FIGS. 7A-D illustrate four example dithering masks 700A-D satisfying both spatio and temporal stacking constraints. As described earlier, for a n-th subframe, a target grayscale value below the grayscale limit $g_L$ may be represented by a subset of dots of the n-th dithering mask (which corresponds to the grayscale limit $g_L$). However, for representing grayscale level values greater than the grayscale limit $g_L$, the system may need to select dots from one or more dithering masks of other subframes (because the dots of one dithering mask can represent grayscale level only up to the grayscale limit $g_L$). As an example and not by way of limitation, the system may generate four dithering masks as shown in FIGS. 7A-D for generating four subframe images (i.e., N=4) to represent the target image. For four subframe images, the grayscale limit may be determined to be 0.25. For a target grayscale value within the range of [0.25, 0.5], the system may need to use all dots in the dot pattern of the n-th dithering mask for the n-th subframe image and select some dots from the dithering mask of another subframe.

As an example and not by way of limitation, for representing a grayscale value gin the range of [0.25, 0.5] in a first subframe image, the system may determine a dot pattern that includes all the dots from the first dithering mask 700A (which corresponds to 0.25) and a subset of dots from the second dithering mask 700B. The subset of dots selected from the second dithering mask 700B may be stacked together to the dot pattern of the first dithering mask to make up the difference portion of the grayscale value to the grayscale limit (i.e., g−0.25). Because the dot pattern of the first dithering mask 700A and the second dithering mask 700B have no overlapping dots, the subset of dots selected from the second dithering mask 700B may be stacked to the dot pattern of the first dithering mask 700A without violating the spatio stacking constraints. As another example, for representing a target grayscale value g in the range of [0.25, 0.5] in the second subframe image, the system may determine a dot pattern that includes all the dots from the second dithering mask 700B and a subset of dots from the third dithering mask 700C. The subset of dots selected from the third dithering mask 700B may be stacked together to the dot pattern of the second dithering mask 700B to make up the difference portion of the target grayscale value to the grayscale limit (i.e., g−0.25). Because the dot pattern of the second dithering mask 700B and the third dithering mask 700C have no overlapping dots, the subset of dots selected from the third dithering mask 700C may be stacked to the dot pattern of the first dithering mask 700B without violating the spatio stacking constraints.

As another example, for representing a target grayscale value g in the range of [0.25, 0.5] in the third subframe image, the system may determine a dot pattern that includes all the dots from the third dithering mask 700C and a subset of dots from the fourth dithering mask 700D. The subset of dots selected from the fourth dithering mask 700D may be stacked together to the dot pattern of the third dithering mask 700C to make up the difference portion of the target grayscale value to the grayscale limit (i.e., g−0.25). Because the dot pattern of the third dithering mask 700C and the fourth dithering mask 700D have no overlapping dots, the subset of dots selected from the fourth dithering mask 700D may be stacked to the dot pattern of the third dithering mask 700C without violating the spatio stacking constraints. As another example, for representing a target grayscale value g in the range of [0.25, 0.5] in a fourth subframe image, the system may determine a dot pattern that includes all the dots from the fourth dithering mask 700D and a subset of dots from the first dithering mask 700A. The subset of dots selected from the first dithering mask 700A may be stacked together to the dot pattern of the fourth dithering mask 70DC to make up the difference portion of the target grayscale value to the grayscale limit (i.e., g−0.25). Because the dot pattern of the fourth dithering mask 700D and the first dithering mask 700A have no overlapping dots, the subset of dots selected from the first dithering mask 700A may be stacked to the dot pattern of the fourth dithering mask 700D without violating the spatio stacking constraints. The principle of selecting dots from other dithering mask for representing target grayscale value in the range of [0.25, 0.5] may be described by the following equations:

$$G_{1|0.25<g<0.5}=G_{1|g=0.25}+G_{2|g\leq 0.25} \quad (6)$$

$$G_{2|0.25<g<0.5}=G_{2|g=0.25}+G_{3|g\leq 0.25} \quad (7)$$

$$G_{3|0.25<g<0.5}=G_{3|g=0.25}+G_{4|g\leq 0.25} \quad (8)$$

$$G_{4|0.25<g<0.5}=G_{4|g=0.25}+G_{1|g\leq 0.25} \quad (9)$$

where, $G_1$, $G_2$, $G_3$, and $G_4$ are the dot set of the first, second, third and fourth subframes, respectively, and g is grayscale level.

In particular embodiments, for representing a target grayscale values in the range of [0.5, 0.75] in the n-th subframe image, the system may need to use all dots in the dot pattern of the n-th dithering mask and select dots from the dithering masks of another two subframes. For example, for representing a target grayscale values in the range of [0.5, 0.75] in the first subframe image, the system may determine a dot pattern that includes all the dots from the first dithering mask 700A (which corresponds to 0.25), all the dots of the second dithering mask 700B (which corresponds to 0.25), and a subset of dots from the third dithering mask 700C. The dots selected from the second dithering mask 700B and the third dithering mask 700C may be stacked together to the dot pattern of the first dithering mask 700A. Because the dot patterns of the first, second and third dithering masks 700A-C have no overlapping dots, the dots selected from the second dithering mask 700B and the third dithering mask 700C may be stacked to the dot pattern of the first dithering mask 700A without violating the spatio stacking constraints.

As another example, for representing a target grayscale value in the range of [0.5, 0.75] in the second subframe image, the system may determine a dot pattern that includes all the dots from the second dithering mask 700B (which corresponds to 0.25), all the dots of the third dithering mask 700C (which corresponds to 0.25), and a subset of dots from the fourth dithering mask 700D. The dots selected from the third dithering mask 700C and the fourth dithering mask 700D may be stacked to the dot pattern of the first dithering mask 700A. Because the dot patterns of the second, third and fourth dithering masks 700B-D have no overlapping dots, the dots selected from the third dithering mask 700B and the fourth dithering mask 700D may be stacked to the dot pattern of the first dithering mask 700B without violating the spatio stacking constraints.

As another example, for representing a target grayscale values in the range of [0.5, 0.75] in the third subframe image, the system may determine a dot pattern that includes all the dots from the third dithering mask 700C (which corresponds to 0.25), all the dots of the fourth dithering mask 700D (which corresponds to 0.25), and a subset of dots from the first dithering mask 700A. The dots selected from the fourth dithering mask 700D and the first dithering mask 700A may be stacked to the dot pattern of the third dithering mask 700C. Because the dot patterns of the third, fourth and first dithering masks 700C, 700D and 700A have no overlapping dots, the dots selected from the fourth dithering mask 700D and the first dithering mask 700A may be stacked to the dot pattern of the third dithering mask 700C without violating the spatio stacking constraints.

As another example, for representing a target grayscale value in the range of [0.5, 0.75] in the fourth subframe image, the system may determine a dot pattern that includes all the dots from the fourth dithering mask 700D (which corresponds to 0.25), all the dots of the first dithering mask 700A (which corresponds to 0.25), and a subset of dots from the second dithering mask 700B. The dots selected from the first dithering mask 700A and the second dithering mask 700B may be stacked to the dot pattern of the fourth dithering mask 700D. Because the dot patterns of the first, second and fourth dithering masks 700A, 700B and 700D have no overlapping dots, the dots selected from the first dithering mask 700A and the second dithering mask 700B may be stacked to the dot pattern of the fourth dithering mask 700D without violating the spatio stacking constraints. The principle of selecting dots from other dithering mask for representing target grayscale value in the range of [0.5, 0.75] may be described by the following equations:

$$G_{1|0.5<g<0.75}=G_{1|g=0.25}+G_{2|g=0.25}+G_{3|g\leq 0.25} \quad (10)$$

$$G_{2|0.5<g<0.75}=G_{2|g=0.25}+G_{3|g=0.25}+G_{4|g\leq 0.25} \quad (11)$$

$$G_{3|0.5<g<0.75}=G_{3|g=0.25}+G_{4|g=0.25}+G_{1|g\leq 0.25} \quad (12)$$

$$G_{4|0.5<g<0.75}=G_{4|g=0.25}+G_{1|g=0.25}+G_{2|g\leq 0.25} \quad (13)$$

where, $G_1$, $G_2$, $G_3$, and $G_4$ are the dot set of the first, second, third and fourth subframes, respectively, g is grayscale level.

In particular embodiments, for representing a grayscale value in the range of [0.75, 1] in the n-th subframe image, the system may need to use all dots in the dot pattern of the n-th dithering mask and select dots from the dithering masks of another three subframes. For example, for representing a target grayscale value in the range of [0.75, 1] in the first subframe, the system may determine a dot pattern that includes all the dots from the first dithering mask 700A (which corresponds to 0.25), all the dots of the second dithering mask 700B (which corresponds to 0.25), all the dots of the third dithering mask 700C, and a subset of dots from the fourth dithering mask 700D. The dots selected from the second, third and fourth dithering masks 700B-D may be stacked to the dot pattern of the first dithering mask 700A. Because the dot patterns of the four dithering masks 700A-D have no overlapping dots, the dots selected from the second, third and fourth dithering masks 700B-D may be stacked to the dot pattern of the first dithering mask 700A without violating the spatio stacking constraints.

As another example, for representing a target grayscale value in the range of [0.75, 1] on the second subframe, the system may determine a dot pattern that includes all the dots from the second dithering mask 700B (which corresponds to 0.25), all the dots of the third dithering mask 700C (which corresponds to 0.25), all the dots of the fourth dithering mask 700D, and a subset of dots from the first dithering mask 700A. The dots selected from the third, fourth and first dithering masks (700C-D and 700A) may be stacked to the dot pattern of the second dithering mask 700B. Because the dot patterns of the four dithering masks 700A-D have no overlapping dots, the dots selected from the third, fourth and first dithering masks (700C-D and 700A) may be stacked to the dot pattern of the second dithering mask 700B without violating the spatio stacking constraints.

As another example, for representing a target grayscale value in the range of [0.75, 1] on the third subframe image, the system may determine a dot pattern that includes all the dots from the third dithering mask 700C (which corresponds to 0.25), all the dots of the fourth dithering mask 700D (which corresponds to 0.25), all the dots of the first dithering mask 700A, and a subset of dots from the second dithering mask 700B. The dots selected from the fourth, first and second dithering masks (700D and 700A-B) may be stacked to the dot pattern of the third dithering mask 700C. Because the dot patterns of the four dithering masks 700A-D have no overlapping dots, the dots selected from the fourth, first and second dithering masks 700D and 700A-B may be stacked to the dot pattern of the third dithering mask 700C without violating the spatio stacking constraints.

As another example, for representing a target grayscale value in the range of [0.75, 1] in the fourth subframe image, the system may determine a dot pattern that includes all the dots from the fourth dithering mask 700D (which corresponds to 0.25), all the dots of the first dithering mask 700A (which corresponds to 0.25), all the dots of the second dithering mask 700B, and a subset of dots from the third dithering mask 700C. The dots selected from the first, second and third dithering masks 700A-C may be stacked to the dot pattern of the fourth dithering mask 700D. Because the dot patterns of the four dithering masks 700A-D have no overlapping dots, the dots selected from the first, second and third dithering masks 700A-C may be stacked to the dot pattern of the fourth dithering mask 700D without violating the spatio stacking constraints. The principle of selecting dots from other dithering mask for representing target grayscale value in the range of [0.75, 1] may be described by the following equations:

$$G_{1|0.75<g<1}=G_{1|g=0.25}+G_{2|g=0.25}+G_{3|g=0.25}+G_{4|g\leq 0.25} \tag{14}$$

$$G_{2|0.75<g<1}=G_{2|g=0.25}+G_{3|g=0.25}+G_{4|g=0.25}+G_{1|g\leq 0.25} \tag{15}$$

$$G_{3|0.75<g<1}=G_{3|g=0.25}+G_{4|g=0.25}+G_{1|g=0.25}+G_{2|g\leq 0.25} \tag{16}$$

$$G_{4|0.5<g<0.75}=G_{4|g=0.25}+G_{1|g=0.25}+G_{2|g=0.25}+G_{3|g\leq 0.25} \tag{17}$$

where, $G_1$, $G_2$, $G_3$, and $G_4$ are the dot set of the first, second, third and fourth subframes, respectively, g is grayscale level. It is notable that the subframe number N=4 is used as an example and the number of subframes is not limited to N=4 and can by any suitable integer number. The systems and methods described in this disclosure may be applicable to any N number of subframes.

In particular embodiments, the system may use an offline process to generate N coupled dithering masks and store the generated N dithering masks in a storage media. During the process of generating subframe images, the system may access the stored dithering masks from the storage media and use the dithering masks to generate N number of subframe images. In particular embodiments, the coupled N number of dithering masks may have a cyclical relationship which allows all the dithering masks to be generated from a single seed mask based on the cyclical relationship. In particular embodiments, the system may only store the seed mask instead of storing all N number of dithering masks and generate all other dithering masks from the seed mask based on the cyclical relationship when they are needed. As a result, the system may reduce the memory usage for storing the dithering mask by a factor of N.

In particular embodiments, the seed mask stored by the system may include the dot pattern having a dot density corresponding the maximum grayscale level (e.g., 1 for normalized grayscale level range [0, 1]). The seed mask may have the same resolution and size with each of the N dithering masks to be generated based on the seed mask. For example, the seed mask and each of the N dithering masks may have the pixel resolution of 100 pixels×100 pixels, 150 pixels×150 pixels, 180 pixels×180 pixels, etc. The dot pattern of the seed mask may include all the dots corresponding to all the pixels of a target region (e.g., a tile region of the same size) of the target image. The threshold values stored in the seed mask may over all the grayscale levels in the quantization range. In particular embodiments, the system may pre-generate the seed mask during an offline process and store the seed mask in a storage media for later use. The pre-generated seed mask may be fixed after being generated and the same seed mask may be used for generating the dithering masks for all target images of a digital content (e.g., all mainframe images of a AR/VR content).

In particular embodiments, for an arbitrary N number of subframes, the system may store a single seed mask (rather than N dithering masks) to reduce the memory usage related to the subframe generating process. For the n-th dithering mask of a total of N dithering mask, the dithering mask may be generated by cyclically permuting the seed mask as described in the following equations:

$$t_n=\mathrm{mod}(t_1-k_n,1) \tag{18}$$

$$k_n=\mathrm{mod}((n-1)g,1) \tag{19}$$

where $t_n$ is the threshold value of the n-th dithering mask; $t_1$ is the threshold value of the seed mask; $k_n$ is the offsetting coefficient; g is the target grayscale value; and mod is the remainder operator. For a target grayscale level g of the n-th subframe image, the system may determine an offsetting coefficient $k_n$ based on a remainder of $(n-1)\cdot g$ divided by 1. Then, the system may determine the threshold values of the n-th subframe mask based on the remainder of $(t_1-k_n)$ divided by 1. The seed mask may include a matrix of threshold values corresponding to all associated dots. The system may repeatedly apply Equation 18 on each of the threshold values to determine the corresponding threshold values of the n-th dithering mask.

As described in earlier sections of this disclosure, for representing grayscale values below the grayscale limit of the system may generate N dithering masks for each of the N subframes and allow the generated N dithering masks to satisfy spatio and temporal stacking constraints. For spatio stacking properties, each dithering mask of the N dithering masks may include a dot pattern having a dot density corresponding to the grayscale limit $g_{max}/N$. The dot pattern of dithering mask may include a stack of dot patterns corresponding to all the lower grayscale levels from 0 to $g_{max}/N$ and the dot pattern of any grayscale level may include all dots of the dot patterns of lower scale levels. For temporal stacking properties, the N dithering masks may be generated in such as way that they have no overlapping dots with each other. For example, for N=4, the system may generate 4 dithering masks whose dot patterns have no overlapping dots with each other. In particular embodiments, the system may divide the grayscale range into N grayscale segments with each segment covering $g_{max}/N$ grayscale level units (with each grayscale level unit corresponding to an incremental grayscale step) and select the seed mask dots covered in each segment as the dots to be included in a dither mask corresponding to that segment. For example, for N=4 and a seed mask covering the threshold values of [0, 1], the system may determine the first, second, third and fourth dithering masks to include the seed mask dots covered by the threshold segments of $0<t_{M1}<=0.25$, $0.25<t_{M2}<=0.5$, $0.5<t_{M2}<=0.75$ and $0.75<t_{M2}<=1$, respectively, where $t_{M1}$, $t_{M2}$, $t_{M3}$ and $t_{M1}$ are threshold values of the first, second, third and fourth dithering masks. Because of the spatio stacking property, the dot pattern of each grayscale level unit or grayscale level step may not have overlapping dots with any other grayscale unit and the dots selected for each dithering mask in this manner may naturally satisfy the temporal stacking property by having no overlapping dots between any two dithering masks.

In particular embodiments, the system may use the cyclical relationship as described in Equations 18 and 19 to determine the threshold values of N dithering masks based on the threshold values of the seed mask. As an example and not by way of limitation, the system may generate 4 subframe images for each mainframe image. For N=4, the grayscale limit may be determined to be 0.25. For representing the grayscale value 0.25, the system may generate 4 dithering masks from a seed mask using cyclical relationship as described in Equations 18 and 19. As described in earlier sections, the seed mask may have a dot pattern corresponding to the maximum grayscale level of 1 for the normalized grayscale range of [0, 1]. For the dithering masks of the first, second, third and fourth subframes, the offset coefficients of $k_1$, $k_2$, $k_3$, and $k_4$ may be determined to be 0, 0.25, 0.5 and 0.75, respectively, by applying Equation 19 as follows:

$$k_1=\mathrm{mod}((1-1)\cdot 0.25,1)=0 \tag{20}$$

$$k_2=\mathrm{mod}((2-1)\cdot 0.25,1)=0.25 \tag{21}$$

$$k_3=\mathrm{mod}((3-1)\cdot 0.25,1)=0.5 \tag{22}$$

$$k_3=\mathrm{mod}((4-1)\cdot 0.25,1)=0.75 \tag{23}$$

Consequently, the threshold values of the first, second, third and fourth dithering masks may be determined by applying Equation 18 as follows:

$$t_{M1}=\mathrm{mod}(t_{SM1}-0,1) \tag{24}$$

$$t_{M2}=\mathrm{mod}(t_{SM1}-0.25,1) \tag{25}$$

$$t_{M3}=\mathrm{mod}(t_{SM1}-0.5,1) \tag{26}$$

$$t_{M2}=\mathrm{mod}(t_{SM1}-0.75,1) \tag{27}$$

where $t_{M1}$, $t_{M2}$, $t_{M3}$ and $t_{M1}$ are threshold values of the first, second, third and fourth dithering masks; $t_{SM}$ is the corresponding threshold values of the seed mask. The system may repeatedly apply these equations to the threshold value of each dot in the seed mask to determine the threshold values of the corresponding dithering masks. As a result, the dithering pattern for the first, second, third and fourth dithering masks may be determined to be $0<t_{M1}<=0.25$, $0<t_{M2}<=0.25$, $0<t_{M2}<=0.25$ and $0<t_{M2}<=0.25$, respectively, where $t_{M1}$, $t_{M2}$, $t_{M3}$ and $t_{M1}$ are threshold values of the first, second, third and fourth dithering masks. In other words, the four dithering masks may have their threshold values shifted by the respective offsetting coefficients to the target threshold range of [0, 0.25]. As a result, each dithering mask may have a dot pattern corresponding the grayscale value of 0.25 and each dithering mask may cover a threshold range of [0, 0.25]. Therefore, for representing any grayscale value less than or equal to the grayscale limit of 0.25, the four subframe images may be generated by applying the four dithering masks to the target mainframe image and the generated subframe images may each satisfy the spatio stacking property and together satisfy the temporal sacking property as described in earlier sections of this disclosure.

In particular embodiments, for representing grayscale values above the grayscale limit of $g_{max}/N$, the system may generate N dithering masks from the seed mask using cyclical relationship as described in Equations 18 and 19. The generated N dithering masks may have overlapping dots but the dot patterns of the dithering masks may be selected in a way satisfying the spatio and temporal stacking property and allowing uniform luminance or energy distribution among the N dithering masks. As described in the earlier sections of this disclosure, the dot patterns with overlapping dots may be determined by selecting or borrowing dots from the dithering masks for other subframes. In particular embodiments, the system may determine the dot patterns of the dithering masks with overlapping dots based on the cyclical relationship as described in Equations 18 and 19.

In particular embodiments, the system may determine N grayscale segments within the grayscale range of [0, 1] and have each grayscale segment cover $g_{max}/N$ grayscale level units (with each grayscale level unit corresponding to an incremental grayscale step). The system may select the seed mask dots covered in each segment as the dots to be included in a dither mask corresponding to that segment. The determination of the grayscale segments and corresponding dot patterns may be performed based on the cyclical relationship by repeatedly applying Equations 18 and 19. As an example and not by way of limitation, for N=4, to represent a target grayscale of 0.6 within a grayscale range of [0, 1], the first, second, third and fourth grayscale segment may be determined to be $0<t_{SM}<=0.6$, $0.2<t_{SM}<=0.8$, $0.4<t_{SM}<=1$, and $0.2<t_{SM}<=0.8$, where $t_{SM}$ is the threshold values of the seed mask. The system may select the dots in the seed mask (which covers the grayscale rang of [0, 1]) covered by the four grayscale segments as to be included in the respective dot patterns of the four dithering masks. For example, the first dithering mask may have a dot pattern including dots of the seed mask covered in the grayscale segment of $0<t_{SM}<=0.6$. The second dithering mask may have a dot pattern including dots of the seed mask covered in the grayscale segment of $0.2<t_{SM}<=0.8$. The third dithering mask may have a dot pattern including dots of the seed mask covered in the grayscale segment of $0.4<t_{SM}<=1$. The fourth dithering mask may have a dot pattern including dots of the seed mask covered in the grayscale segment of $0.2<t_{SM}<=0.8$.

It is notable that the selection of the dot patterns for the dithering masks is for example purpose and the section of dot patterns is not limited by these segments or ranges. It is also notable that the determination of the dot patterns of the dithering masks may not depend on the order of the grayscale segments or ranges. Any threshold segments or ranges in any order that allow the dot patterns of the dithering masks to satisfy the spatio-temporal stacking property and have uniform luminance distribution among the subframes may be used for determining the dot patterns of the dithering masks. For example, the dot pattern of the first, second, third and fourth dithering mask may include dots of the seed mask covered by the threshold segments of $0<t_{SM}<=0.6$, $0.2<t_{SM}<=0.8$, $0.2<t_{SM}<0.8$, and $0.4<t_{SM}<=1$. It is notable that some threshold segments may be determined by a wrap-around operation. For example, since the range of [0.6, 1.2] is out of the grayscale range of [0, 1], the system may use a wrap-around operation to determine the grayscale segments of [0.6, 1] and [0, 0.2] which also cover a grayscale range of the same width.

For N=4, to represent a target grayscale of 0.6 within a grayscale range of [0, 1], the offset coefficients $k_1$, $k_2$, $k_3$, and $k_4$ of the first, second, third and fourth dithering masks may be determined to be 0, 0.6, 0.2 and 0.8, respectively, by applying Equation 19 as follows:

$$k_1=\mathrm{mod}((1-1)\cdot 0.6,1)=0 \tag{20}$$

$$k_2=\mathrm{mod}((2-1)\cdot 0.6,1)=0.6 \tag{21}$$

$$k_3=\mathrm{mod}((3-1)\cdot 0.6,1)=0.2 \tag{22}$$

$$k_3=\mathrm{mod}((4-1)\cdot 0.6,1)=0.8 \tag{23}$$

Consequently, the threshold values of the first, second, third and fourth dithering masks may be determined by applying Equation 18 as follows:

$$t_{M1}=\mathrm{mod}(t_{SM1}-0,1) \tag{24}$$

$$t_{M2}=\mathrm{mod}(t_{SM1}-0.6,1) \tag{25}$$

$$t_{M3}=\mathrm{mod}(t_{SM1}-0.2,1) \tag{26}$$

$$t_{M2}=\mathrm{mod}(t_{SM2}-0.8,1) \tag{27}$$

where $t_{M1}$, $t_{M2}$, $t_{M3}$ and $t_{M1}$ are threshold values of the first, second, third and fourth dithering masks; $t_{SM}$ is the corresponding threshold values of the seed mask. The system may repeatedly apply these equations to the threshold value of each dot in the seed mask to determine the threshold values of the corresponding dithering masks. As a result, the dithering pattern for the first, second, third and fourth dithering masks may be determined to be $0<t_{M1}<=0.6$, $0<t_{M2}<=0.6$, $0<t_{M2}<=0.6$ and $0<t_{M2}<=0.6$, respectively, where $t_{M1}$, $t_{M2}$, $t_{M3}$ and $t_{M1}$ are threshold values of the first, second, third and fourth dithering masks. The system may use these four dithering masks to generate four subframe images and each of the subframe images may have a dot pattern which has a dot density corresponding to the target grayscale value of 0.6.

In particular embodiments, the system may use the dithering masks to determine the values to be dithered for arbitrary grayscale values. For a display with evenly-spaced M-bit grayscale levels and N temporal subframes, the system may dither an arbitrary target grayscale value g using the processes described as follows. In particular embodiments, the system may define the least significant bit (LSB) as $LSB=1/(2^M-1)$. For example, the LSB values for displays of 8 bits, 6 bits, and 4 bits may be determined to be 1/255, 1/63, and 1/7. The whole part of the grayscale value w may be determined to by w=LSB·floor(g/LSB). The remainder r, which has the range of [0, 1], may be determined by r=(g−w)/LSB. For the n-th subframe, the offset coefficient $k_n$ may be determined to be $k_n=\mathrm{mod}((n-1)\cdot r, 1)$. Consequently, the threshold values of the n-th subframe may be determined by $t_n=\mathrm{mod}(t_1-k_n, 1)$. The system may display the whole part of the grayscale value w in the n-th subframe and dither the remainder r temporally to other subframes. For the subframe that receives the dithered remainder, the total displayed grayscale value may be determined as by $d_n=w+(r>t_n)\cdot LSB$.

In particular embodiments, the system may use the dithering masks to determine values to be deterred for arbitrary grayscale values. For a display with unevenly-spaced J-bit grayscale levels and N temporal subframes, the system may dither an arbitrary target grayscale value g using the processes described as follows. In particular embodiments, the system may define the least significant bit (LSB) as the difference between the adjacent grayscale levels (i.e., $w_{j+1}-w_j$). The system may determine the index j corresponding to the closest grayscale level $w_j$ that is smaller than g which is between the $w_j$ and $w_{j+1}$. The system may determine the remainder r, which is in the range of [0, 1], by $r=(g-w_j)/(w_j-w_{j+1})$. For the n-th subframe, the offset coefficient $k_n$ may be determined by $k_n=\mathrm{mod}((n-1)\cdot r, 1)$. Consequently, the threshold values of the n-th subframe may be determined by $t_n=\mathrm{mod}(t_1-k_n, 1)$. The system may display the whole part of the grayscale value w in the n-th subframe and dither the remainder r temporally to other subframes. For the subframe that receives the dithered remainder, the total displayed grayscale value may be determined as by $d_n=w_{j+(r>tn)}$.

In particular embodiments, to represent any grayscale value g by N subframe images, the system may generate N dithering masks from the seed mask based on the cyclical relationship. The generated N dithering masks may have dot patterns satisfying both spatio stacking property and temporal stacking property. The threshold values of N dithering masks may be determined by shifting the grayscale ranges of the seed mask with the offset coefficients determined using Equation 18. After shifted, the four dithering masks may each have a dot pattern covering a threshold range of $0<t_M<=g$. The system may use the N dithering masks to generate N subframe images each of which may have a dot density corresponding to the target grayscale value g. The N subframe images may have uniform luminance distribution or energy distribution with each other. As a result, to perform spatio-temporal dithering for any arbitrary number of subframes, the system may only need to store a seed mask and generate all the dithering masks from the seed mask using the cyclical relationship when the dithering masks are needed for generating the subframe images.

It is notable that the systems, methods, and processes for determining the dot patterns based on the remainder operations are for example purpose and the generating of dot patterns of the dithering masks is not limited thereof. As long as the four dithering masks covers N grayscale ranges and the dot patterns are determined in a manner satisfying the spatio and temporal stacking property, the generated dithering masks may be qualified for being used to generate the subframe images. This disclosure covers all suitable systems, methods and processes for generating dot patterns of the dithering masks satisfying the spatio and temporal stacking properties as described in earlier sections of this disclosure.

Figure 8A:
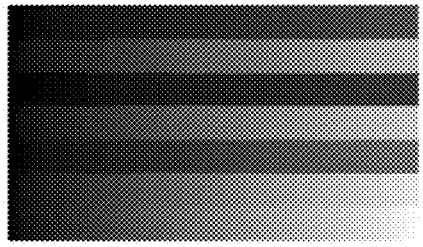
FIG. 8A illustrates an example target image to be represented by a series of subframe images with less gray level.
Figure 8B:
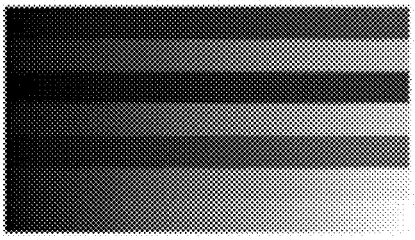
FIGS. 8B-E illustrate four example subframe images generated using the mask-based spatio-temporal dithering method.
Figure 8C:
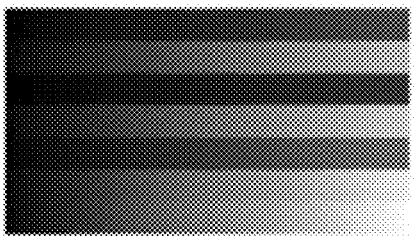
Figure 8D:
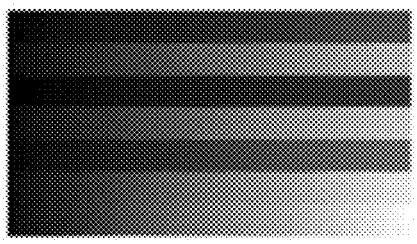
Figure 8E:
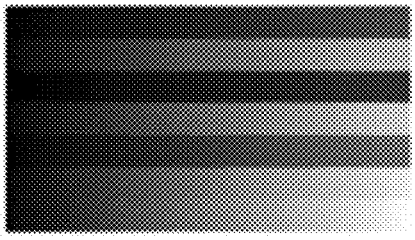

FIG. 8A illustrates an example target image 800A to be represented by a series of subframe images with less gray level. FIGS. 8B-E illustrate four example subframe images 800B-E generated using the mask-based spatio-temporal dithering method. By using the mask-based dithering method, the system may generate a series of subframe images with even distribution of luminance. The target image 800A may have more gray level bits than the physical display. The subframe image 800B-E may have gray level bits corresponding to the physical display and less than the target image 800A. The subframe image 800B-E may be used to represent the target image using the time average as perceived by viewers. The system may generate four dithering masks and use the four dithering masks to generate the four subframe images of 800B-E, as described in the earlier section of this disclosure. As a result, the subframe image 800B-E may have more even distribution of luminance among the subframe images (e.g., comparing to the subframe image 400B-D where there is great luminance contrast among the subframe images.) In particular embodiments, the AR/VR system may use a scanning waveguide displays, 2D micro-LED displays for displaying AR/VR content to users. The systems and methods described in this disclosure are applicable to, but are not limited to, the scanning waveguide display, the 2D micro-LED displays, or any suitable displays for AR/RV systems.

Figure 9:
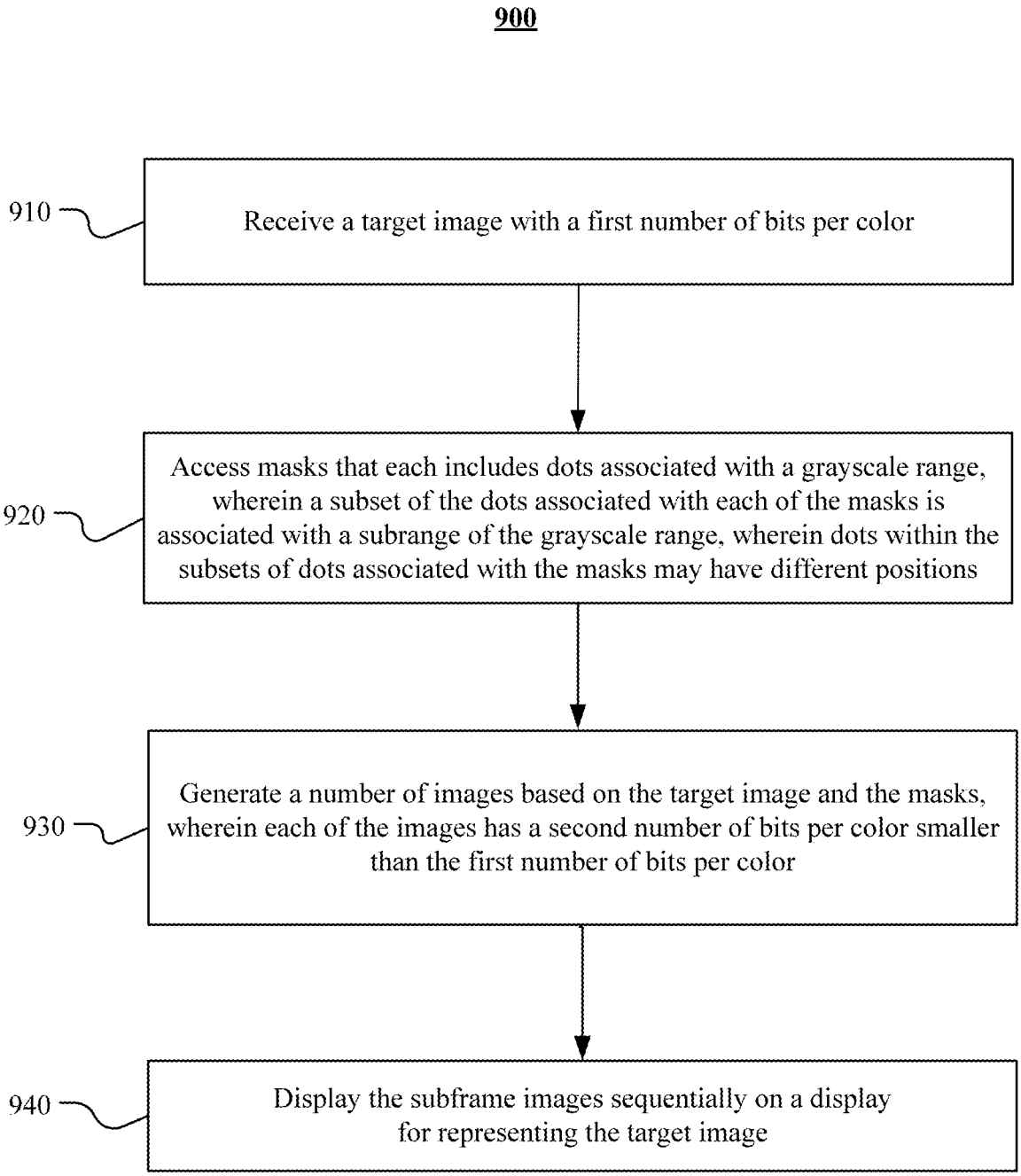
FIG. 9 illustrates an example method for using a mask-based dithering method to generate a series of subframe images to represent a target image.

FIG. 9 illustrates an example method 900 for using mask-based dithering method to generate a series of subframe images to represent a target image. The method 900 may begin at step 910, where the system may receive a target image which may have a first number of bits per color corresponding to a first color depth. The target image may include a number of tile regions each of which may be used as a target region and may be represented by corresponding tile region of a number of images with less color bits per color. The average grayscale value of each target region may be used as a target grayscale value for the quantization process. At step 920, the system may access masks that each includes dots associated with a grayscale range. A subset of the dots associated with each of the masks may be associated with a subrange of the grayscale range. The dots within the subsets of dots associated with the masks may have different positions, or in other words, each subset of dots associated with each mask may include a unique set of dots from other masks. The dots of each mask may be associated with a dot pattern which may include a number of stacked dot patterns. Each of the stacked dot patterns may satisfy a spatio stacking constraint by including all dots of the dot patterns corresponding to all lower grayscale levels. For example, the system may access N number of dithering masks each of which includes a dot pattern and each dot pattern may include a number of stacked dot patterns. The subset dots of the dot pattern of each of the dithering masks may include a set of dots exclusive to the dot patterns of other masks. In particular embodiments, the N number of dithering masks may be pre-generated and stored in the computer storage or accessed from the computer storage when they are needed. In particular embodiments, the N number of dithering masks may be generated when they are needed based on a single seed mask stored in the computer storage. Each dithering mask may have the same size to the target region of the target image. Each dithering mask may include a dot pattern satisfying a spatio stacking constraint and a temporal stacking constraint. The dot pattern may include a number of dots in blue-noise distribution. The dot pattern of each of the masks may include a number of dot patterns (e.g., spatially stacked together) corresponding to all grayscale levels of a quantization grayscale range. Each dot of the dot pattern may be associated with a threshold value which may equal to the lowest grayscale level which has a corresponding dot pattern including that dot. Each dithering mask may have threshold values corresponding to all grayscale levels of the quantization grayscale range. Each of the stacked dot patterns may satisfy the spatio stacking constraint. In other word, a dot pattern of the stacked dot patterns corresponding to a grayscale level may include all dots of the dot patterns corresponding to all lower grayscale levels. The sum of the dot patterns of the masks may also have a blue-noise property. The quantization grayscale range may have evenly-placed grayscale levels or unevenly-placed grayscale levels.

At step 930, the system may generate a number of images based on the target image and the masks. Each of the image may have a second number of bits per color which is smaller than the first number of bits per color. For example, the system may generate N number of subframe images based on the target image and N dithering masks. Each of the subframe images may have color values with a second number of bits per color (e.g., grayscale values in a second bit length). The second number of bits per color may correspond to the color depth of the display which may be smaller than the first number of bits per color. In other words, the N number of subframe images may have less color depth comparing to the target image. The dithering masks satisfying the temporal stacking constraint may allow the subframe images to have the uniform luminance distribution among the images (e.g., each image has luminosity within a threshold range). In particular embodiments, the N dithering mask may be made available at the same time for a process of generating the subframe images. The system may determine one or more quantitation errors based on one or more color values of the target image and one or more threshold values associated with one of the dithering masks. The system may dither the quantization errors temporally to one or more other subframe images without using an error buffer. A subframe image may be generated by repeatedly applying the corresponding mask to the target image.

At step 940, the system may display the subframe images sequentially on the display for representing the target image. As a result, the subframe images used for representing the target image may have even luminance distribution among the subframe images (e.g., having luminosity within a threshold range). In particular embodiments, the system may generate a seed mask which may include threshold values covering a quantization grayscale range. The system may store the seed mask in a storage media and access the seed mask from the storage media for generating the N dithering masks from the seed mask based on a cyclical relationship, and therefore reduce the storage space usage for generating the subframe images. In particular embodiments, the system may determine a grayscale limit $g_L$ based on a maximum grayscale level $g_{MAX}$ and the N number of subframe images for representing the target image (e.g., $g_L=g_{MAX}/N$). When the target grayscale value for a tile region of the subframe images is smaller than the grayscale limit, the corresponding tile regions of the subframe images may be generated based on the non-overlapping dithering masks which include non-overlapping set of dots from each other. Consequently, the corresponding tile regions of the subframe images may include non-overlapping sets of pixels from each other. When a target grayscale value associated with the target image is greater than the grayscale limit, the corresponding tile regions of the subframe images may be generated based on N number of overlapping dithering masks which include overlapping dots incrementally selected from at least another dithering mask. The N number of overlapping masks may be generated by incrementally selecting dots from at least another mask of the plurality of masks. Consequently, the corresponding tile regions of the subframe images may include overlapping sets of pixels which may be determined by incrementally selecting dots from at least another mask of the masks.

Particular embodiments may repeat one or more steps of the method of FIG. 9, where appropriate. Although this disclosure describes and illustrates particular steps of the method of FIG. 9 as occurring in a particular order, this disclosure contemplates any suitable steps of the method of FIG. 9 occurring in any suitable order. Moreover, although this disclosure describes and illustrates an example method for using mask-based dithering method to generate a series of subframe images to represent a target image including the particular steps of the method of FIG. 9, this disclosure contemplates any suitable method for using mask-based dithering method to generate a series of subframe images to represent a target image including any suitable steps, which may include all, some, or none of the steps of the method of FIG. 9, where appropriate. Furthermore, although this disclosure describes and illustrates particular components, devices, or systems carrying out particular steps of the method of FIG. 9, this disclosure contemplates any suitable combination of any suitable components, devices, or systems carrying out any suitable steps of the method of FIG. 9.

Figure 10:
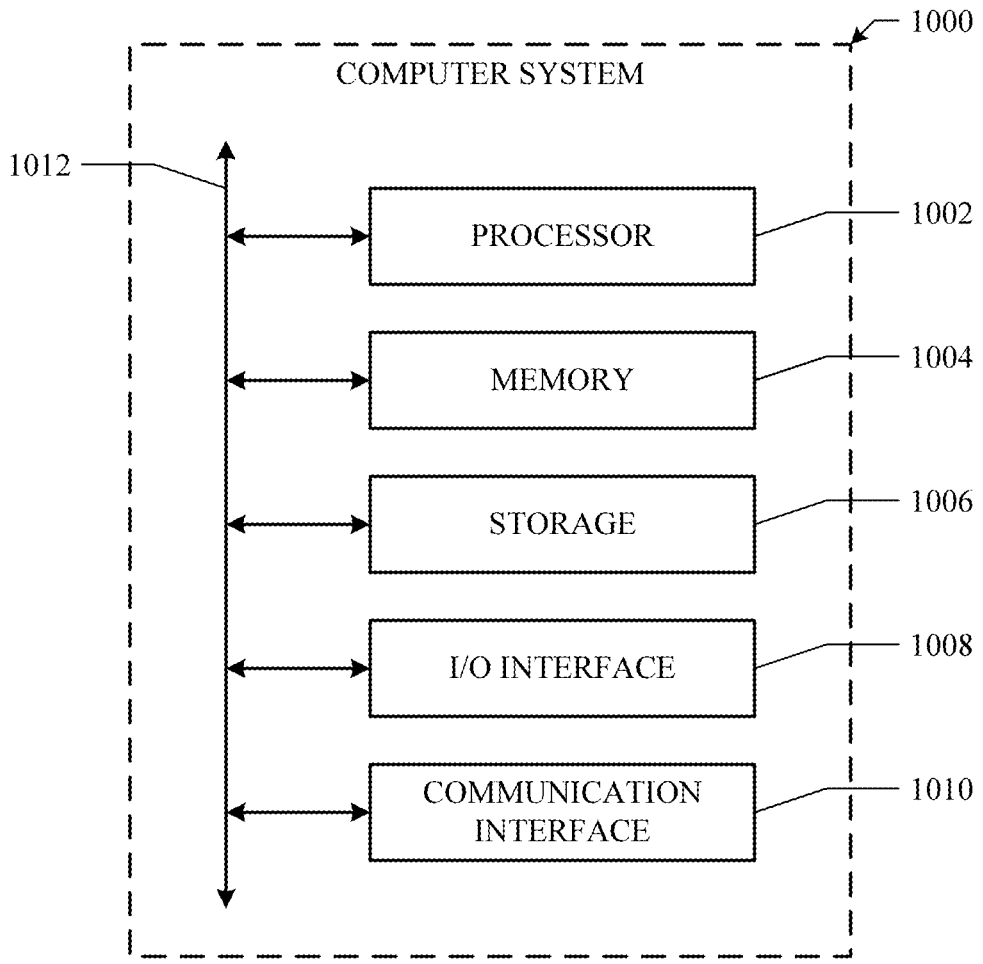
FIG. 10 illustrates an example computer system.

FIG. 10 illustrates an example computer system 1000. In particular embodiments, one or more computer systems 1000 perform one or more steps of one or more methods described or illustrated herein. In particular embodiments, one or more computer systems 1000 provide functionality described or illustrated herein. In particular embodiments, software running on one or more computer systems 1000 performs one or more steps of one or more methods described or illustrated herein or provides functionality described or illustrated herein. Particular embodiments include one or more portions of one or more computer systems 1000. Herein, reference to a computer system may encompass a computing device, and vice versa, where appropriate. Moreover, reference to a computer system may encompass one or more computer systems, where appropriate.

This disclosure contemplates any suitable number of computer systems 1000. This disclosure contemplates computer system 1000 taking any suitable physical form. As example and not by way of limitation, computer system 1000 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 1000 may include one or more computer systems 1000; be unitary or distributed; span multiple locations; span multiple machines; span multiple data centers; or reside in a cloud, which may include one or more cloud components in one or more networks. Where appropriate, one or more computer systems 1000 may perform without substantial spatial or temporal limitation one or more steps of one or more methods described or illustrated herein. As an example and not by way of limitation, one or more computer systems 1000 may perform in real time or in batch mode one or more steps of one or more methods described or illustrated herein. One or more computer systems 1000 may perform at different times or at different locations one or more steps of one or more methods described or illustrated herein, where appropriate.

In particular embodiments, computer system 1000 includes a processor 1002, memory 1004, storage 1006, an input/output (I/O) interface 1008, a communication interface 1010, and a bus 1012. Although this disclosure describes and illustrates a particular computer system having a particular number of particular components in a particular arrangement, this disclosure contemplates any suitable computer system having any suitable number of any suitable components in any suitable arrangement.

In particular embodiments, processor 1002 includes hardware for executing instructions, such as those making up a computer program. As an example and not by way of limitation, to execute instructions, processor 1002 may retrieve (or fetch) the instructions from an internal register, an internal cache, memory 1004, or storage 1006; decode and execute them; and then write one or more results to an internal register, an internal cache, memory 1004, or storage 1006. In particular embodiments, processor 1002 may include one or more internal caches for data, instructions, or addresses. This disclosure contemplates processor 1002 including any suitable number of any suitable internal caches, where appropriate. As an example and not by way of limitation, processor 1002 may include one or more instruction caches, one or more data caches, and one or more translation lookaside buffers (TLBs). Instructions in the instruction caches may be copies of instructions in memory 1004 or storage 1006, and the instruction caches may speed up retrieval of those instructions by processor 1002. Data in the data caches may be copies of data in memory 1004 or storage 1006 for instructions executing at processor 1002 to operate on; the results of previous instructions executed at processor 1002 for access by subsequent instructions executing at processor 1002 or for writing to memory 1004 or storage 1006; or other suitable data. The data caches may speed up read or write operations by processor 1002. The TLBs may speed up virtual-address translation for processor 1002. In particular embodiments, processor 1002 may include one or more internal registers for data, instructions, or addresses. This disclosure contemplates processor 1002 including any suitable number of any suitable internal registers, where appropriate. Where appropriate, processor 1002 may include one or more arithmetic logic units (ALUs); be a multi-core processor; or include one or more processors 1002. Although this disclosure describes and illustrates a particular processor, this disclosure contemplates any suitable processor.

In particular embodiments, memory 1004 includes main memory for storing instructions for processor 1002 to execute or data for processor 1002 to operate on. As an example and not by way of limitation, computer system 1000 may load instructions from storage 1006 or another source (such as, for example, another computer system 1000) to memory 1004. Processor 1002 may then load the instructions from memory 1004 to an internal register or internal cache. To execute the instructions, processor 1002 may retrieve the instructions from the internal register or internal cache and decode them. During or after execution of the instructions, processor 1002 may write one or more results (which may be intermediate or final results) to the internal register or internal cache. Processor 1002 may then write one or more of those results to memory 1004. In particular embodiments, processor 1002 executes only instructions in one or more internal registers or internal caches or in memory 1004 (as opposed to storage 1006 or elsewhere) and operates only on data in one or more internal registers or internal caches or in memory 1004 (as opposed to storage 1006 or elsewhere). One or more memory buses (which may each include an address bus and a data bus) may couple processor 1002 to memory 1004. Bus 1012 may include one or more memory buses, as described below. In particular embodiments, one or more memory management units (MMUs) reside between processor 1002 and memory 1004 and facilitate accesses to memory 1004 requested by processor 1002. In particular embodiments, memory 1004 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 1004 may include one or more memories 1004, where appropriate. Although this disclosure describes and illustrates particular memory, this disclosure contemplates any suitable memory.

In particular embodiments, storage 1006 includes mass storage for data or instructions. As an example and not by way of limitation, storage 1006 may include a hard disk drive (HDD), a floppy disk drive, flash memory, an optical disc, a magneto-optical disc, magnetic tape, or a Universal Serial Bus (USB) drive or a combination of two or more of these. Storage 1006 may include removable or non-removable (or fixed) media, where appropriate. Storage 1006 may be internal or external to computer system 1000, where appropriate. In particular embodiments, storage 1006 is non-volatile, solid-state memory. In particular embodiments, storage 1006 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 1006 taking any suitable physical form. Storage 1006 may include one or more storage control units facilitating communication between processor 1002 and storage 1006, where appropriate. Where appropriate, storage 1006 may include one or more storages 1006. Although this disclosure describes and illustrates particular storage, this disclosure contemplates any suitable storage.

In particular embodiments, I/O interface 1008 includes hardware, software, or both, providing one or more interfaces for communication between computer system 1000 and one or more I/O devices. Computer system 1000 may include one or more of these I/O devices, where appropriate. One or more of these I/O devices may enable communication between a person and computer system 1000. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 1008 for them. Where appropriate, I/O interface 1008 may include one or more device or software drivers enabling processor 1002 to drive one or more of these I/O devices. I/O interface 1008 may include one or more I/O interfaces 1008, where appropriate. Although this disclosure describes and illustrates a particular I/O interface, this disclosure contemplates any suitable I/O interface.

In particular embodiments, communication interface 1010 includes hardware, software, or both providing one or more interfaces for communication (such as, for example, packet-based communication) between computer system 1000 and one or more other computer systems 1000 or one or more networks. As an example and not by way of limitation, communication interface 1010 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 1010 for it. As an example and not by way of limitation, computer system 1000 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 1000 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 1000 may include any suitable communication interface 1010 for any of these networks, where appropriate. Communication interface 1010 may include one or more communication interfaces 1010, where appropriate. Although this disclosure describes and illustrates a particular communication interface, this disclosure contemplates any suitable communication interface.

In particular embodiments, bus 1012 includes hardware, software, or both coupling components of computer system 1000 to each other. As an example and not by way of limitation, bus 1012 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 1012 may include one or more buses 1012, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A method comprising, by a computing system:

receiving a target image with a first number of bits per color;

accessing a seed mask from a storage media;

generating a set of masks based on the seed mask, wherein each of the set of masks comprises a plurality of first dot patterns that observe a spatial stacking property;

generating a plurality of images based on the target image and the set of masks, wherein each of the plurality of images has a second number of bits per color smaller than the first number of bits per color; and displaying the plurality of images sequentially in time domain on a display for representing the target image, wherein the plurality of images comprise a plurality of second dot patterns for representing corresponding grayscale values, and wherein the plurality of second dot patterns of the plurality of images observe a temporal stacking property across the plurality of images.

2. The method of claim 1, wherein each of the set of masks is generated from the seed mask by cyclically permuting the seed mask.

3. The method of claim 1, wherein the seed mask comprises a plurality of dots forming a plurality of third dot patterns with each dot of the seed mask being associated with a third dot pattern, wherein each of the plurality of third dot patterns corresponds to a grayscale value in a quantization grayscale range, and wherein the plurality of third dot patterns observe a spatial stacking property by comprising all third dot patterns corresponding to all lower grayscale levels.

4. The method of claim 3, wherein each dot of the seed mask is associated with a threshold value, and wherein the threshold value corresponds to a lowest grayscale level which has a corresponding third dot pattern that comprises that dot.

5. The method of claim 3, wherein the quantization grayscale range corresponds to the second number of bits per color, and wherein the display has the second number of bits per color.

6. The method of claim 3, wherein the quantization grayscale range has a plurality of evenly-space grayscale values or a plurality of unevenly-spaced grayscale values.

7. The method of claim 1, wherein the plurality of images are generated by satisfying a constraint associated with the temporal stacking property, and wherein the constraint allows each image of the plurality of images to have a luminosity within a threshold range.

8. The method of claim 1, wherein the set of masks generated based on the seed mask are available at a same time for a process of generating the plurality of images, further comprising:

determining one or more quantization errors based on one or more color values of the target image and one or more threshold values associated with one of the set of masks; and dithering the one or more quantization errors temporally to one or more images of the plurality of images without using an error buffer.

9. The method of claim 1, wherein each of the plurality of first dot patterns has a blue-noise property, and wherein a sum of the plurality of first dot patterns has a blue-noise property.

10. The method of claim 1, further comprising:

determining a grayscale limit based on a maximum grayscale level and a quantity value of images of the plurality of images for representing the target image.

11. The method of claim 10, wherein, in response to a determination that a target grayscale value associated with the target image is smaller than the grayscale limit, corresponding regions of the plurality of images are represented by non-overlapping sets of pixels from each other.

12. The method of claim 10, wherein, in response to a determination that a target grayscale value associated with the target image is greater than the grayscale limit, corresponding regions of the plurality of images are represented by overlapping sets of pixels, and wherein the overlapping sets of pixels are determined by incrementally selecting dots from at least another mask of the set of masks.

13. The method of claim 1, wherein the plurality of images are generated by repeatedly applying a corresponding mask of the set of masks to the target image.

14. The method of claim 12, wherein an average grayscale value of a target region of the target image is used as the target grayscale value, and wherein each of the set of masks has a same size with the target region of the target image.

15. One or more computer-readable non-transitory storage media embodying software that is operable when executed to:

receive a target image with a first number of bits per color;

access a seed mask from a storage media;

generate a set of masks based on the seed mask, wherein each of the set of masks comprises a plurality of first dot patterns that observe a spatial stacking property;

generate a plurality of images based on the target image and the set of masks, wherein each of the plurality of images has a second number of bits per color smaller than the first number of bits per color; and display the plurality of images sequentially in time domain on a display for representing the target image, wherein the plurality of images comprise a plurality of second dot patterns for representing corresponding grayscale values, and wherein the plurality of second dot patterns of the plurality of images observe a temporal stacking property across the plurality of images.

16. The media of claim 15, wherein each of the set of masks is generated from the seed mask by cyclically permuting the seed mask.

17. The media of claim 15, wherein the seed mask comprises a plurality of dots forming a plurality of third dot patterns with each dot of the seed mask being associated with a third dot pattern, wherein each of the plurality of third dot patterns corresponds to a grayscale value in a quantization grayscale range, and wherein the plurality of third dot patterns observe a spatial stacking property by comprising all third dot patterns corresponding to all lower grayscale levels.

18. A system comprising:

one or more non-transitory computer-readable storage media embodying instructions; and one or more processors coupled to the storage media and operable to execute the instructions to:

receive a target image with a first number of bits per color;

access a seed mask from a storage media;

generate a set of masks based on the seed mask, wherein each of the set of masks comprises a plurality of first dot patterns that observe a spatial stacking property;

generate a plurality of images based on the target image and the set of masks, wherein each of the plurality of images has a second number of bits per color smaller than the first number of bits per color; and display the plurality of images sequentially in time domain on a display for representing the target image, wherein the plurality of images comprise a plurality of second dot patterns for representing corresponding grayscale values, and wherein the plurality of second dot patterns of the plurality of images observe a temporal stacking property across the plurality of images.

19. The system of claim 18, wherein each of the set of masks is generated from the seed mask by cyclically permuting the seed mask.

20. The system of claim 18, wherein the seed mask comprises a plurality of dots forming a plurality of third dot patterns with each dot of the seed mask being associated with a third dot pattern, wherein each of the plurality of third dot patterns corresponds to a grayscale value in a quantization grayscale range, and wherein the plurality of third dot patterns observe a spatial stacking property by comprising all third dot patterns corresponding to all lower grayscale levels.

* * * * *